US006240761B1

(12) United States Patent
Suzuki et al.

(10) Patent No.: US 6,240,761 B1
(45) Date of Patent: Jun. 5, 2001

(54) TOOL CONTROLLING APPARATUS

(75) Inventors: Ryoichi Suzuki; Takeharu Hamade; Hiroyuki Sawai, all of Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 09/321,734

(22) Filed: May 28, 1999

(30) Foreign Application Priority Data

May 28, 1998 (JP) ..... 10-146874

(51) Int. Cl.[7] ..... B21D 15/04
(52) U.S. Cl. ..... 72/106; 72/110
(58) Field of Search ..... 72/106, 108, 110

(56) References Cited

U.S. PATENT DOCUMENTS 4,173,134 * 11/1979 Huuskonen et al. ..... 72/106
4,454,739 * 6/1984 Ciccorelli ..... 72/106
4,869,088 * 9/1989 Kadotani ..... 72/106
5,450,738 * 9/1995 Chatterly et al. ..... 72/106

FOREIGN PATENT DOCUMENTS 2-25235 * 1/1990 (JP) ..... 72/106
1496886 * 7/1989 (SU) ..... 72/106
1509163 * 9/1989 (SU) ..... 72/106

* cited by examiner

*Primary Examiner*—Ed Tolan
(74) *Attorney, Agent, or Firm*—Sughrue, Mion, Zinn, Macpeak & Seas, PLLC

(57) ABSTRACT

A tool controlling apparatus includes a position controlling unit and a torque controlling unit for carrying out the conversion between the position control and the torque control of the tool for pushing the work, and the conversion of the torque in the torque control in a moment by using a servo motor in the course of process of the work.

6 Claims, 17 Drawing Sheets

COMPARISON OF WORK BETWEEN THE PRESENT INVENTION AND RELATED ART

| | PRESENT INVENTION | RELATED ART |
|---|---|---|
| STABLE MINIMUM FINISHING FEED SPEED | 0.008mm/rev | 0.05mm/rev |
| VARIATION OF CIRCULARITY | 0.05mm | 0.5mm |
| DIMENSION OF OBJECT RING | OUTER DIAMETER 100mm<br>INNER DIAMETER 85mm<br>WIDTH 25mm | |
| MATERIAL STATE | HOT FORGING MATERIAL | |
| LUBRICATING OIL | MINERAL OIL SYSTEM | |

TOOL CONTROLLING APPARATUS

BACKGROUND OF THE INVENTION

1. Field of the Invention

The present invention relates to a tool controlling apparatus and, more particularly, a tool controlling apparatus for executing appropriately position control and torque control of a tool acting on a work. Further, more particularly, the present invention relates to a tool controlling apparatus which can provide a high precision work with high circularity not to disturb the diameter expansion of the work during rolling process as forming process of the work.

2. Description of the Related Art

The annular body forming apparatus which is one of tool controlling apparatuses in the related art has been disclosed in Japanese Patent Examined Publication (KOKOKU) Hei 3-31534. In this apparatus, the work is sandwiched between a forming roller and a mandrel, the forming roller is rotated upon an axis which is parallel with the mandrel, and a diameter of the work is expanded by pushing the forming roller relatively against the work to roll the work while rotating the work. At this time, guide rails, etc. support the work as the annular body during the rolling process to keep circularity of the work. An outer diameter detecting lever which contacts an outer peripheral surface of the work and a sensor for detecting a displacement amount of the outer diameter detecting lever are provided. The outer diameter of the work can be detected by the outer diameter detecting lever and the sensor during the process.

FIG. 19 is a sectional view showing the rolling situation of the annular body forming apparatus in the related art. In the rolling process by the annular body forming method in the related art, contact between a work 305 and a forming roller 315 is changed from point contact to surface contact by bringing the forming roller 315 close to the work 305 relatively in the initial feed. After the forming roller 315 has come into surface contact with the work 305, the forming roller 315 and a mandrel 304 are then brought close to each other at a predetermined quick feed in the rough feed. Thus, the work 305 is rolled by a large torque, a diameter expanding speed of the work 305 is accelerated, and the torque in the rough feed has a maximum value during the rolling process.

At this time, a pair of guide rollers 306 are employed to support an outer surface of the work 305 while fixing position of the work 305. If a work holding force by the guide rollers 306 is insufficient at this point of time, abnormal vibration is easily generated in a work rolling portion. In addition, because polygonal components are generated once the vibration is generated, it is impossible to form the round work, so that the outer diameter of the work 305 becomes uneven.

Then, when the outer diameter of the work 305 reaches a diameter to be switched to the finishing feed, a relative moving speed between the mandrel 304 and the forming roller 315 is reduced to improve the circularity of the work 305 by reducing a cutting push-down amount mm/rev (one revolution) (referred to as a "draft amount" hereinafter), and then the process is shifted to the finishing feed. When it is detected that a torque in the finishing feed become a steady state and then the outer diameter of the work 305 comes up to a predetermined dimension, the rolling process is terminated.

Normally, if the torque of the guide rollers 306 is set small in the finishing feed rather than the rough feed, the diameter expansion of the work is not disturbed and thus the good working can be attained. In this manner, such a problem has existed that the stable working conditions cannot be achieved since the torque is changed largely during the rolling process. In particular, as for the hydraulic guide rollers in the related art, it has not been apparent how the pushing force against the work should be changed in respective steps of the rolling process. Therefore, it is continued to apply a constant pushing force to the work from a run-in period of the initial rolling (initial feed) to the end of the finishing feed. Particularly, if the work is guided in the finishing feed stage by the same pushing force against the work as in the rough feed stage, it is possible to spoil the circularity of the work 305. Especially, if the thin work is to be rolled, the above event which is the influence of the pushing force of the guide rollers 306 applied to the work 305 becomes prominent. In addition, because of cycle shortening, it is desired that, in respective stages from the end of the finishing feed to the release of the guide rollers 306, the guide rollers 306 must return quickly to the home position to start the next working. In this manner, according to the annular body forming apparatus in the related art, it has been difficult to attain both the improvement in working efficiency and the improvement in working precision simultaneously.

A mechanism of the guide rollers 306 is constructed such that the guide rollers 306 are fitted on both upstream and downstream sides of the position, at which the work 305 is put between the mandrel 304 and the forming roller 315 to accept the plastic working, so as to sandwich the work 305, then apply the constant force to the work 305, and then are moved back by a force generated when the diameter of the work 305 is expanded by the rolling process. In this case, the work 305 is swung to one side when one of a pair of guide rollers 306 pushes the work 305, and the other of a pair of guide rollers 306 receives such swing force at that time to absorb the swing of the work 305. This phenomenon is repeated like a so-called resonance phenomenon, so that it is difficult to stabilize the position of the work 305. Therefore, respective guide rollers must be synchronized forcibly to be opened/closed simultaneously, otherwise a one-way clutch which is set free in the direction along which the work is excessively pushed to prevent the excessive pushing of the work 305, etc. must be incorporated. In particular, if such resonance phenomenon cannot be prevented in the finishing stage, the circularity of the work 305 is degraded extremely.

In order to improve a precision of the circularity of the work, the draft amount must be reduced by setting the finishing feed employed to roll the work 305 at a low speed. At this time, unless reduction of the draft amount is carried out so as to avoid the above resonance phenomenon, the work with good thickness deviation and circularity cannot be obtained. As the result of many experiments of the rolling process, it has been found that a relationship between pushing forces of the upstream and downstream guide rollers 306 in the finishing feed has an effect on the precision of the circularity. In other words, it has been found that it is preferable that the pushing force of the guide roller applied to the work should be made small in the finishing feed rather than the rough feed, or it is important that the pushing force of the downstream guide roller is set stronger to support the work 305 than the upstream guide roller. In addition, if the small pushing forces rather than those in the rough feed are applied from both upstream and downstream guide rollers in the finishing feed, or if the strong pushing force is applied to the work by the upstream guide roller 306 when the plastic working of the work 305 is executed in the finishing feed, the circularity is deteriorated. Therefore, the upstream guide roller must be positioned away from the work 305.

When the work is rolled by increasing the draft amount since at first the work has wrong profiles of work material such as the thickness deviation, the circularity, etc., the resonance phenomenon appears apparently. Therefore, in order to prevent the resonance phenomenon, a function of strongly pushing the work by the guide rollers 306 from both the upstream and downstream sides (up to the rough feed) must be applied.

However, when the process is shifted to the finishing feed, the thickness deviation and the circularity are gradually corrected and thus the resonance phenomenon caused between the work and the guide rollers is reduced rather than the rough feed, so that the position of the work can be stabilized. FIG. 18 is a side view showing the situation of the work which is subjected to the rolling working between a forming roller and a mandrel. As shown in FIG. 18, a thickness t0 of the work prior to the rolling process is larger than a thickness ta of the work after the rolling process and an inlet velocity v1 of the work prior to the rolling process is smaller than an outlet velocity v0 of the work after the rolling process, and also the direction of the velocity is abruptly changed. Furthermore, since the work has the thickness deviation in the rough feed of the mandrel, or since the draft amount per revolution of the mandrel against the work is selected largely, the downstream rolling portion is pushed out strongly unless the guide rollers are provided, so that the position of the work becomes unstable to thus cause the vibration. If the pushing forces of the upstream and downstream guide rollers become uneven or are reduced small at the time of such unstable state, the resonance of the work is caused up and down vertically on the basis of a shaft center X—X connecting a center of the mandrel and a center of the forming roller. Unless such vibration is stopped, not only the rolling process of the work becomes difficult due to the vibration but also the thickness deviation and the circularity of the work are not corrected or sometimes they become worse, and further the damage of the die is caused.

SUMMARY OF THE INVENTION

Therefore, the invention has an object to form a work with excellent circularity by applying particularly position control and torque control of guide rollers as one of tools so as to execute them selectively in respective rolling steps, more particularly, by switching the control of the work between the position control, which is executed before starting the rolling process between a mandrel and a forming roller (after the home position before the start of the initial feed) and at the time of returning the guide rollers to the home position after a finishing feed has been completed, and the torque control, which is executed to provide desired pushing forces (torques) in remaining intermediate rolling steps.

In order to achieve the above object, the present invention is characterized by providing both a position controlling unit and a pushing controlling unit of guide rollers as one of tools. Therefore, the present invention employs a servo motor (or hydraulic pushing mechanism) as one example, and controls an operation of the guide rollers for supporting the work in a mechanism which rolls the work between a mandrel as a tool for processing the work and a forming roller. In particular, a feature of the present invention resides in that the present invention is applied to control of the operation of the guide rollers among the tools. Thus, according to the present invention, there is provided a tool controlling apparatus which can work or push a work by moving the work and a tool relatively during processing of the work, and including a position controlling unit for controlling position of the tool from start of working or pushing of the work to end thereof, and a pushing controlling unit for controlling a working or pushing force of the tool, which is applied to guide the work. Where the position controlling unit denotes all the portions for controlling both contact and non-contact between the guide rollers serving as the tool and the work at high speed based on values of the current position counter and the deviation counter. The pushing controlling unit denotes all the units for controlling the pushing force (torque value of the servo motor herein) of the tool against the work in response to requests in respective rolling steps. The forming process in the present invention includes all the working steps for applying the pushing force to the work, and then an example in which the present invention is applied to the rolling process will be explained as a representative example.

More particularly, the invention applies to an annular body forming apparatus, in which the work is rolled into desired dimensional profiles by the rolling process of the work as the annular body, and including the guide rollers, which support the work so as to sandwich the shaft center (referred to as a "shaft center X—X line" hereinafter) connecting a center of the mandrel and a center of the forming roller. Then, the annular body forming apparatus includes the position controlling unit which is utilized to control the back-and-forth position of the guide rollers, against the work in the quick feed during when the guide rollers are moved quickly close to the work and the unloading step during when the guide rollers are returned to the original position (home position) after the rolling process has been completed, and the pushing controlling unit which is utilized to control the pushing force of the guide rollers against the work in respective rolling steps which the work is rolled by the mandrel and the forming roller between the initial feed, the rough feed, and the finishing feed.

As an example of the present invention in which the servo motor is applied to the guide rollers for supporting the work, in operation, the guide rollers are moved quickly close to the work according to the position control, then the quick feed is continued before a rolling starting point of the work, then the work is held by the guide rollers at a precise position. Then the position control is switched to the torque control by the electric signal to mate with the start of the initial feed of the rolling process of the work, then this is switched to desired values in respective steps of the initial feed, the rough feed, and the finishing feed of the rolling process of the work. Further, the torque control is switched to the position control by the electric signal at the time of the rolling process termination of the work to release the holding of the work quickly and to return the guide rollers to the home position, whereby the position control and the torque control are switched by an electric signal to mate with the progress of the rolling process of the work. As a result, high precision rolling process of the work can be achieved and also the rolling process cycle of the work can be shortened.

The annular body forming apparatus includes a moving unit for moving relatively the forming roller, which is rotated with contacting the outer peripheral surface of the work serving as the annular body, and the mandrel, which can be moved relatively to contact the inner peripheral surface of the work, a pair of guide rollers for holding the rolled position of the work by rolling on the outer peripheral surface of the work, a servo motor for driving the guide rollers, and a controller for controlling the position control and the torque control, and a dimension fixing lever as an outer diameter detecting unit for detecting the outer diameter of the rolled work, whereby the work is put between the forming roller and the mandrel by approaching the forming roller and the mandrel relatively to execute the initial feed, the rough feed, and the finishing feed. According to this configuration, the control scheme of the guide rollers can be varied between the position control and the torque control and also displacement can be controlled timely in torque control.

Furthermore, as another tool control unit included in the invention, a circularity assuring unit for manufacturing stably the work with high circularity precision may be attached. According to the circularity assuring unit, both guide rollers are brought into contact with the work during the rolling process from the initial feed to the rough feed of the work, then the guide rollers are moved back with the diameter expansion due to the rolling process while applying the desired pushing force to the work to hold the work. Then the upstream guide roller is opened by the same opening angle as the downstream guide roller from the existing contact state position of the work and the guide rollers (the opening angle relative to the turning center is kept as it is) from the end point of the rough feed (entrance of the finishing feed step). That is, the upstream guide roller is opened simultaneously in linking with the opening angle of the downstream guide roller, and then the upstream guide roller is separated from the work while controlling the downstream guide roller to retreat (with the diameter expansion of the work) by the predetermined torque in the finishing feed and thus the downstream side of the work is supported and held by the downstream guide roller solely.

More particularly, the length of the downstream arm is set longer than that of the upstream arm. Here, the length of the arm denotes a length of the arm of each guide roller. The guide rollers are made to follow the outer peripheral surface of work by the angles corresponding to the lengths of respective arms in the initial feed and the rough feed, whereas the guide roller attached onto the downstream arm is made to follow the outer peripheral surface of the work while receiving the torque control, and the linking guide roll attached onto the upstream arm is away from the work in the finishing feed. In this manner, the position of the work can be stabilized merely by pushing the downstream arm (by the guide roller) with the proper torque, without pushing by the upstream arm. In other words, in order to correct the position of the work, it is desired for improvement in the circularity to reduce the upstream pushing force to "0" in the finishing feed step by separating the upstream guide roller from the work, while applying the torque of the downstream guide roller (not only the torque of the servo motor but also the hydraulic force may be employed), i.e., the pushing and supporting force for the work.

FIG. 6 is a diagram showing conditions for pushing the work by a downstream guide roller after releasing an upstream guide roller from the work in finishing feed step. As for the torque for driving the guide rollers, both the upstream and downstream guide rollers are retreated with the diameter expansion by the rolling of the work while contacting the outer peripheral surface of the work to apply the equal pushing force to the work in the initial feed and the rough feed, nevertheless the pushing force is applied to the work from the downstream guide roller but the upstream guide roller is released from the work not to apply the pushing force thereto in the finishing feed since the upstream and downstream guide rollers are opened (by the equal angle) simultaneously. If a reaction force which exceeds a torque set value is applied from the work 5 to the guide rollers 6 in the torque control in respective feed steps (respective rolling steps), the guide rollers 6 are pushed back until the torque is balanced with the set torque. In addition, when the rolling process by the mandrel 4, which is inserted into the work 5, and the forming roller 3 proceeds, the outer diameter of the work 5 is enlarged, as shown in FIG. 6. That is, the radius is changed from a radius Ro to a radius Rw.

The guide rollers are opened by an angle θ02 on the upstream side and an angle θ01 on the downstream side with respect to a turning center of the guide rollers to follow the diameter expansion of the work immediately before the finishing feed, and the guide rollers contact the outer periphery of the work. At this time, assume that an arm length of the upstream guide roller is A2, and an arm length of the downstream guide roller is A1, and A1>A2. Immediately before entering the finishing feed, a distance between a work center and a turning center of the guide rollers is changed from Ro+L prior to start of the diameter expansion of the (initial) work to Rw+L in the final finishing feed step (where an expanded radius of any work is Rw). Since the arms of the upstream and downstream guide rollers are moved simultaneously (as back-and-forth movement against the work) from the state where the guide rollers come into contact with the work 5 by the angles θ01, θ02 at the time of starting the finishing feed, the angles θ01, θ02 do not become equal because of A1>A2. The angles θ01, θ02 can be given as θ01>θ02 by a following equation.

Expression 1

$$(Ro+rg)^2 = A_1^2 + (Ro+L)^2 - 2A_1\cdot(Ro+L)\cos\theta 01 \quad (1)$$

$$= A_2^2 + (Ro+L)^2 - 2A_2\cdot(Ro+L)\cos\theta 02$$

According to this equation, A1/A2>cos θ01/cos θ02>1 can be given.

$$\therefore \theta 01 > \theta 02$$

Therefore, in view of the situation (shown in FIG. 6) that the opening angles of the upstream and downstream guide rollers being operated simultaneously are increased by the angle Δθ with the diameter expansion of the work, the opening angle of the downstream guide roller is increased by the angle Δθ when it is pushed back against the torque from the downstream guide roller to the opposite side to the work, and the upstream guide roller is also opened by the angle Δθ by the servo motor because it is opened together with the down stream guide roller. However, as a conclusion, distances between a center of the work whose diameter is expanded and centers of the guide rollers are set as S on the upstream side and K on the down stream side, S>K can be derived, as indicated by following equations.

Expression 2

Assume following equations $$\theta U = \theta 02 + \Delta\theta \quad (a)$$

$$\theta L = \theta 01 + \Delta\theta \quad (b)$$

$$K = Rw + rG \quad (c)$$

$$X = L + Rw \quad (d)$$

as premises, $$S^2=X^2+A_2^2-2A_2X\cos\theta U \quad (1)$$

$$K^2=X^2+A_1^2-2A_1X\cos\theta L \quad (2)$$

$$S^2-k^2=A_2^2-A_1^2+2X[A_1\cos\theta L-A_2\cos\theta U] \quad (3)$$

can be given. In Eq. (3), since $A_2^2-A_1^2<0$, $$A_2X\cos\theta U<A_1X\cos\theta L \quad (4)$$

must be satisfied in order to provide S>K. Based on Eq. (4), $$A_1/A_2>\cos\theta U/\cos\theta L>1 \quad (5)$$

From Eq.(1), $$A_1^2-A_2^2=2(Ro+L)\,[A_1\cos\theta 01-A_2\cos\theta 02]>0$$

can be obtained, and thus $$A_1/A_2>\cos(\theta 02+\Delta\theta)/\cos(\theta 01+\Delta\theta)=\cos\theta U/\cos\theta L>1$$

can always be satisfied since the relationship of A1/A2>cos θ02/cos θ01 can always be satisfied (since θ01>θ02). In other words, S>K is needed in order to separate the upstream guide roller from the work even if the downstream guide roller comes into contact with the work when the diameter of the work is expanded, but such relationship can be satisfied by setting A1>A2. (Where $0\leqq\theta 01, \theta 02, \theta U, \theta L\leqq\pi/2$)

More particularly, since the distance K (downstream side) is small according to the relationship of the arm length of the guide rollers A1>A2, the torque control is applied at the distance K side by which the downstream guide roller contacts the work. However, the upstream guide roller does not contact the work since the distance S which is longer than K is given to the upstream guide roller. That is, the upstream guide roller is opened by the larger angle than the downstream guide roller. This corresponds to the situation that, even though the opening angle (Δθ) of the upstream guide roller is controlled by the same servo motor control as the downstream guide roller, the relationship θL>θU can be achieved because of A1>A2 and thus the upstream guide roller never contacts the work. Hence, the constraint torque of the upstream guide roller for the work becomes "0". Therefore, the torque control can be effected only by the downstream guide roller by creating the relationships A1>A2 and θL>θU (angles to start the pushing of the guide rollers). As a result, the arm of the downstream guide roller must be set longer than that of the upstream guide roller.

As such, when said guide rollers 6 ($\mathbf{6}_u$, $\mathbf{6}_d$) contact the work 5, the positions of the upstream and down stream guide rollers 6 ($\mathbf{6}_u$, $\mathbf{6}_d$) are maintained so that a first arc $arc_1$ of the work 5 extending from the first contact position $CP_1$ to a contact point $CP_d$ of the work 5 contacting the downstream guide roller $\mathbf{6}_d$ is longer than a second arc $arc_2$ of the work 5 extending from the first contact position $CP_1$ to a contact point $CP_u$ of the work 5 contacting the upstream guide roller $\mathbf{6}_u$.

More particularly, a pair of guide rollers are brought into contact with the work to oppose to each other with respect to the shaft center X—X line and to push the work until the rough feed in which the draft amount by the mandrel is large, whereby the position of the work is controlled. But, the draft amount is reduced in the finishing feed, and thus difference between an inlet velocity v1 and an outlet velocity vo becomes small not to generate the vibration. That is, the position of the work can be stabilized against the shaft center X—X line. Under such situation, the upstream guide roller is brought into the non-contact state to be separated from the work, whereas the downstream guide roller is brought into the contact state to apply a desired pushing force to the work. In this manner, one type of self-aligning effects to prevent the deviation is ready to stabilize the rolling process, the circularity of the work can be improved rather than the case where the pushing force is applied to both guide rollers so as to contact the work. As described above, the present invention can vary the supporting and pushing force (torque) of the guide rollers to a desired value from the initial feed to the finishing feed, and the further invention can control the torque of the downstream guide roller merely in the finishing feed after the upstream guide roller has been released, so that they can be used properly based on initial thickness deviation and the circularity of the work or the thickness of the work.

DETAILED DESCRIPTION OF THE PREFERRED EMBODIMENTS

First Embodiment

Figure 1:
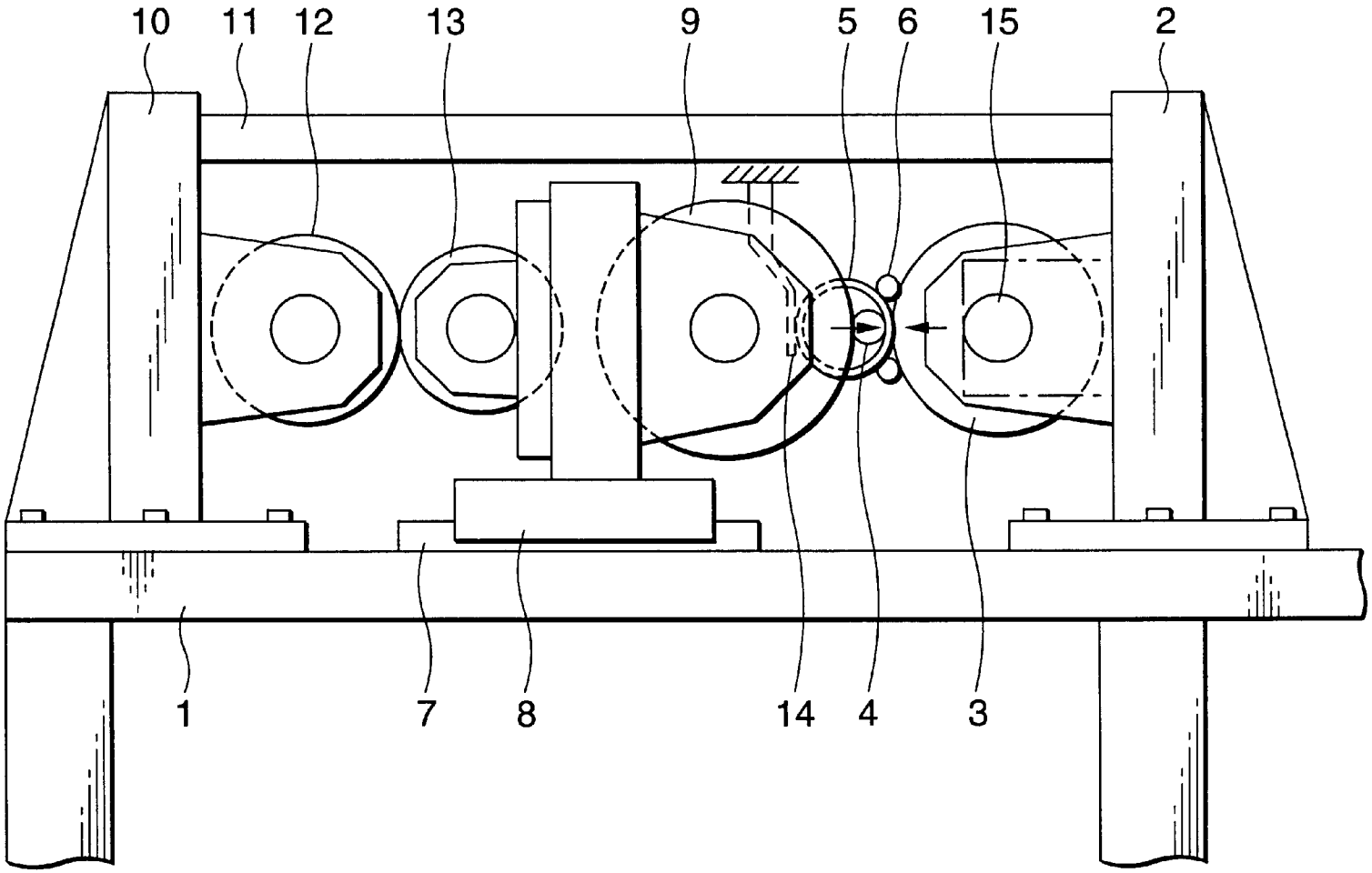
FIG. 1 is a side view showing a schematic configuration when the present invention is applied to an annular body forming apparatus.

A first embodiment of the present invention will be explained with reference to the accompanying drawings hereinafter. In the first embodiment of the present invention, an annular body forming apparatus is employed as a tool controlling apparatus. FIG. 1 is a side view showing a schematic configuration of the tool controlling apparatus when the present invention is applied to the annular body forming apparatus. A first supporting block 2 is provided to one end of a bed 1, and then a forming roller 3 is supported rotatably to the first supporting block 2. In an area located near a center of the bed 1 rather than the first supporting block 2, a mandrel 4 is supported rotatably to a mandrel supporting axis (not shown) in parallel with a forming roller axis 15 of the forming roller 3. Two guide rollers 6 are provided on upper and lower sides of the mandrel 4 so as to push a work 5.

A die employed to form an outer peripheral surface of the work 5 is formed on an outer peripheral surface of the forming roller 3. The forming roller 3 is rotated by a rotating output of a forming roller driving motor (not shown). The work 5 is sandwiched by the forming roller 3 and the mandrel 4 by bringing the mandrel 4 close to the forming roller 3, which is to be rotated and driven, to then carry out the rolling process. The mandrel 4 is inserted into the work 5. The work 5 is pushed and supported by the guide rollers 6 and the mandrel 4 during the rolling process to prevent the mismatch.

Rails 7 which can extend along the longitudinal direction of the bed 1 are provided in the substantially middle portion of the bed 1. A push-down slide 8 is loaded on the rails 7. A support roller 9 which can push the mandrel 4 toward the forming roller 3 is provided on the right side of the push-down slide 8. The support roller 9 is constructed by arranging two same circular plates at a distance coaxially, and is supported rotatably around an axis positioned in parallel with a rotation axis of the forming roller 3. Also, the support roller 9 can push the mandrel 4 against the forming roller 3 in the situation that the work is put between two sheets of circular plates.

A second support block 10 is provided to the other end of the bed 1, and the second support block 10 and the first supporting block 2 are coupled with each other by a tie rod 11. An eccentric circular plate cam 12 is supported to the second support block 10 such that it can be rotated upon the axis positioned in parallel with the rotation axis of the forming roller 3. The circular plate cam 12 has a lift amount in proportion to a rotation angle, and is rotated and driven by a cam drive motor (not shown) which consists of a servo motor.

A circular plate type cam follower 13 is provided on the left side of the push-down slide 8 so as to come into contact with the circular plate cam 12. The cam follower 13 is pushed by an outer peripheral surface of the circular plate cam 12 according to the rotation angle of the circular plate cam 12. Thus, the push-down slide 8 is moved and then the mandrel 4 is pushed against the forming roller 3 by the support roller 9 being provided on the right side of the push-down slide 8. According to one revolution of the circular plate cam 12, respective shifts of the mandrel 4 into the quick feed, the initial feed, the rough feed, the finishing feed, and the unloading state are completed.

A dimension fixing lever 14 is provided between the mandrel 4 and an axis of the support roller 9 so as to contact the outer peripheral surface of the work 5. The dimension fixing lever 14 is moved pursuant to that the work 5 is rolled to expand its diameter. The outer diameter of the work 5 can be detected by measuring such movement of the dimension fixing lever 14 during the rolling process. A switching signal in the rolling step can be derived from this sensor signal.

Figure 2:
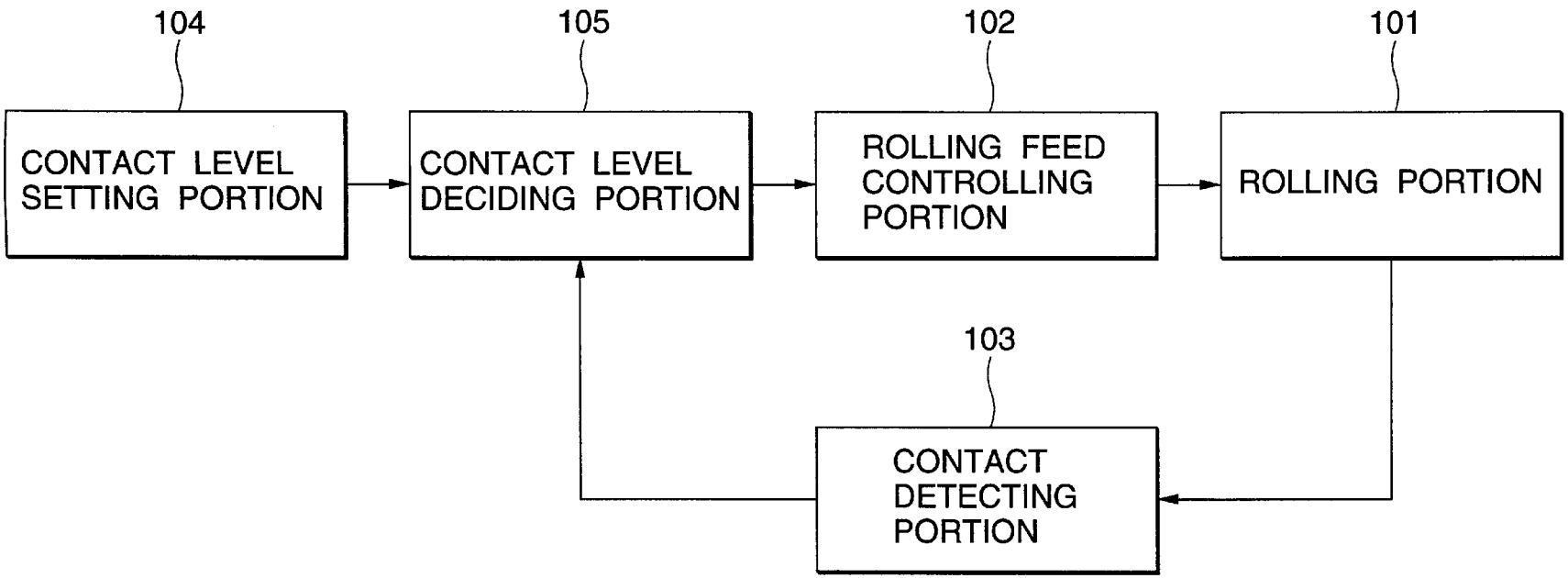
FIG. 2 is a block diagram showing a schematic configuration of a control system for controlling operations of the annular body forming apparatus in FIG. 1 other than a pair of guide rollers 6.

Next, a control system for controlling operations of the annular body forming apparatus in FIG. 1 will be explained with reference to FIG. 2 hereunder. FIG. 2 is a block diagram showing a schematic configuration of the control system for controlling operations of the annular body forming apparatus in FIG. 1 other than a pair of guide rollers 6. A rolling portion 101 is a mechanical configuration for executing the rolling process, and corresponds substantially to the overall annular body forming apparatus shown in FIG. 1. A rolling feed controlling portion 102 is a control unit for controlling the feed of the mandrel 4 in the rolling portion 101.

A contact detecting portion 103 is a mechanism for measuring a parameter indicating whether or not the work is brought into contact with the forming roller 3. In the present embodiment, the contact detecting portion 103 is composed of a power sensor (current sensor) (not shown) for measuring a driving power of the above forming roller driving motor. A detected value of the contact detecting portion 103 is output to a contact level deciding portion 105. A contact level setting portion 104 is a memory device in which a threshold value for contact decision of the above parameter is set. The threshold value being set is supplied to the contact level deciding portion 105.

The contact level deciding portion 105 compares the parameter (driving power value) measured by the contact detecting portion 103 with the above threshold value being set by the contact level setting portion 104, and then decides whether or not the work 5 has been brought into contact with the forming roller 3. Decision results in the contact level deciding portion 105 are output to the rolling feed controlling portion 102. This rolling feed controlling portion 102 then changes a feed speed of the mandrel 4 in the rolling portion 101 in response to the decision results. The mandrel feeding amount relative to a time is decided by the rolling feed controlling portion 102 in FIG. 2.

Next, an operation of the annular body forming apparatus will be explained with reference to FIGS. 3–5, and 7–10 hereunder.

Figure 9:
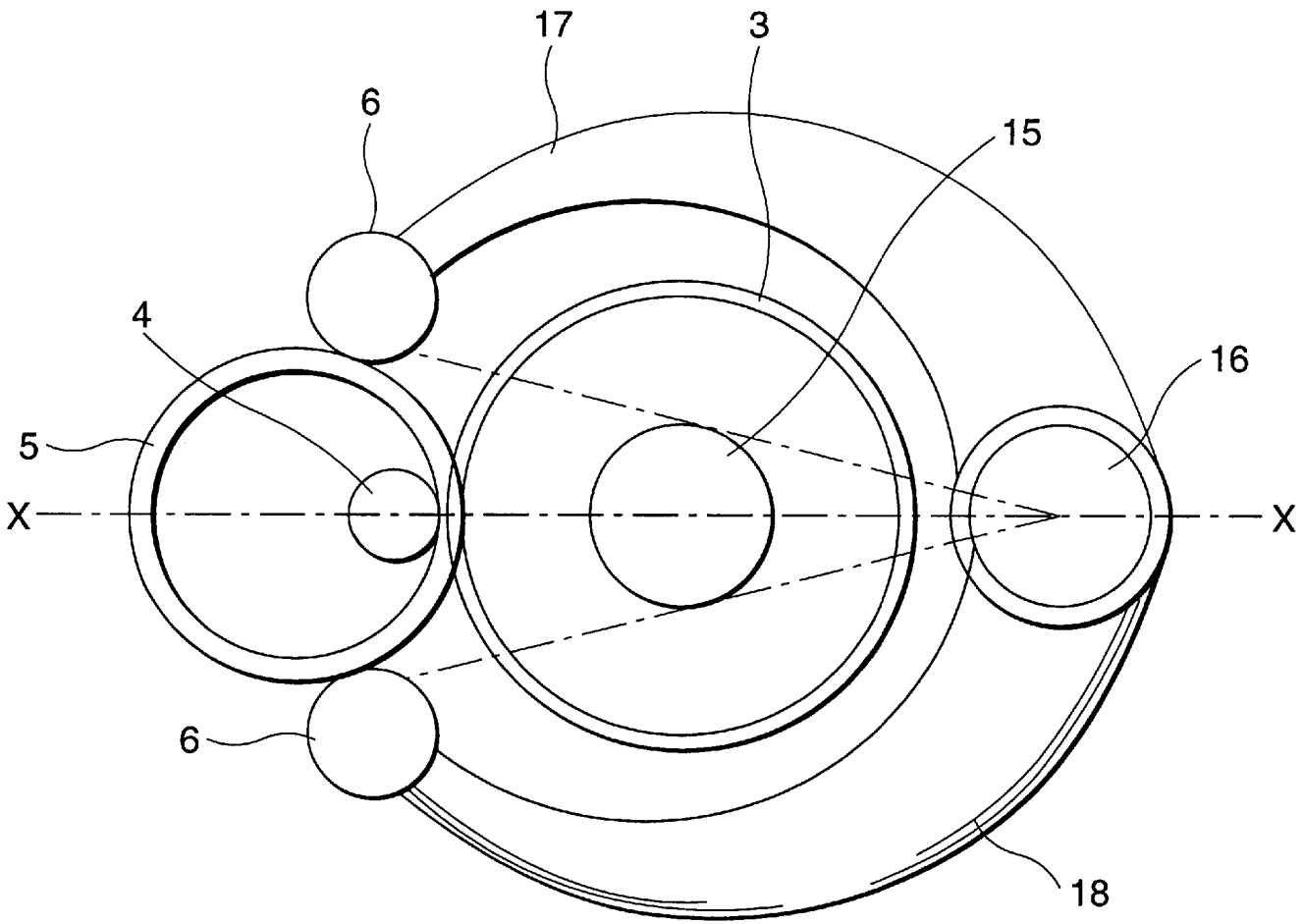
FIG. 9 is a plan view showing an annular body forming apparatus of a first embodiment of the present invention.

In FIG. 9, an arm supporting axis 16 and the mandrel 4 are arranged respectively on the right and left sides of the forming roller 3, into which a forming roller axis 15 is inserted, such that respective central positions are aligned on a straight line. The work 5 is interposed between the forming roller 3 and the mandrel 4. The upstream arm 17 and the downstream arm 18 are fitted to the arm supporting axis 16 to turn the guide rollers 6 symmetrically with respect to a shaft center X—X line. The upstream arm 17 and the downstream arm 18 extend to the outer peripheral surface of the work 5 like a circular arc to bring the guide roller 6 into contact with the outer peripheral surface of the work 5. The arm supporting axis 16 acting as a strut of the guide roller 6 is supported by arm supporting axis brackets (not shown). The guide roller 6 is fitted to the arm in the present embodiment, but a rotatable roller may be employed.

Figure 8:
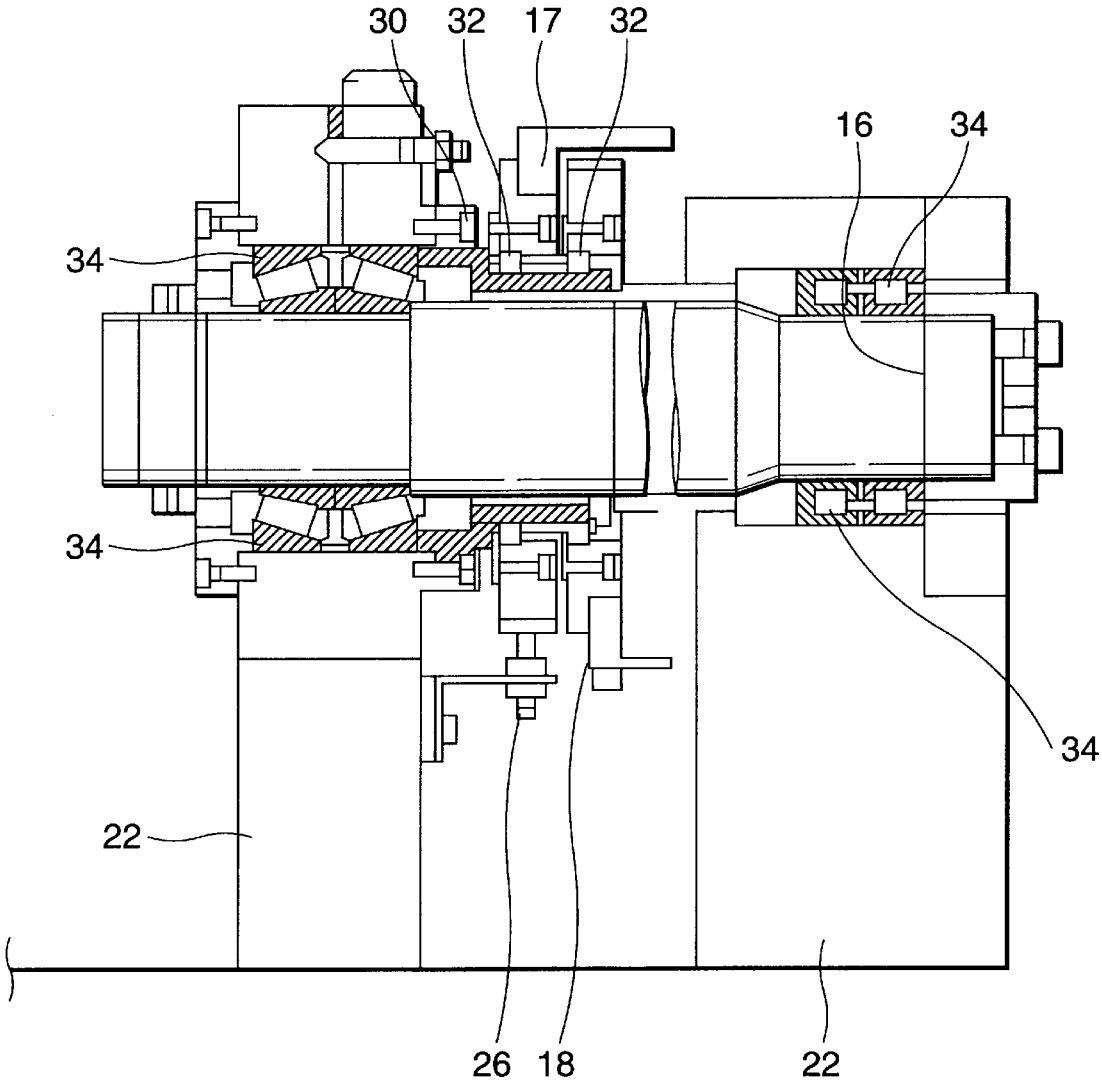
FIG. 8 is a detailed sectional view showing an arm supporting axis in the embodiments of the present invention.

In FIG. 8, since the arm supporting axis 16 is driven by a motor, it is supported rotatably by arm supporting brackets 22 via bearings 32 and tapered roller bearings 34. As shown in FIG. 9, the arm supporting axis 16 is positioned in parallel with a forming roller axis 15. Also, in order to position the arm supporting axis 16, the arm supporting axis 16 is fitted and supported by arm supporting axis brackets 22 not to rotate. An intermediate member 30 is arranged in a center portion of the arm supporting axis 16, and the upstream arm 17 and the downstream arm 18 are fitted rotatably to the intermediate member 30 via the bearings 32. The bearings 32 are fixed to the intermediate member 30 at a different position in the axial direction. An outer ring of one of the bearings 32 is fixed to the downstream arm 18 and the other of the bearings 32 is fixed to the upstream arm 17 such that the upstream arm 17 and the downstream arm 18 are supported rotatably to the intermediate member 30. In this case, the arm supporting axis 16 shown in FIG. 8 may be employed commonly with the forming roller axis 15 to reduce the number of parts. In FIG. 8, a current position sensor 26 is provided to the downstream arm 18, but such current position sensor 26 can be provided to both the upstream arm 17 and the downstream arm 18. A current position counter 84 is provided in the current position sensor 26.

Figure 10:
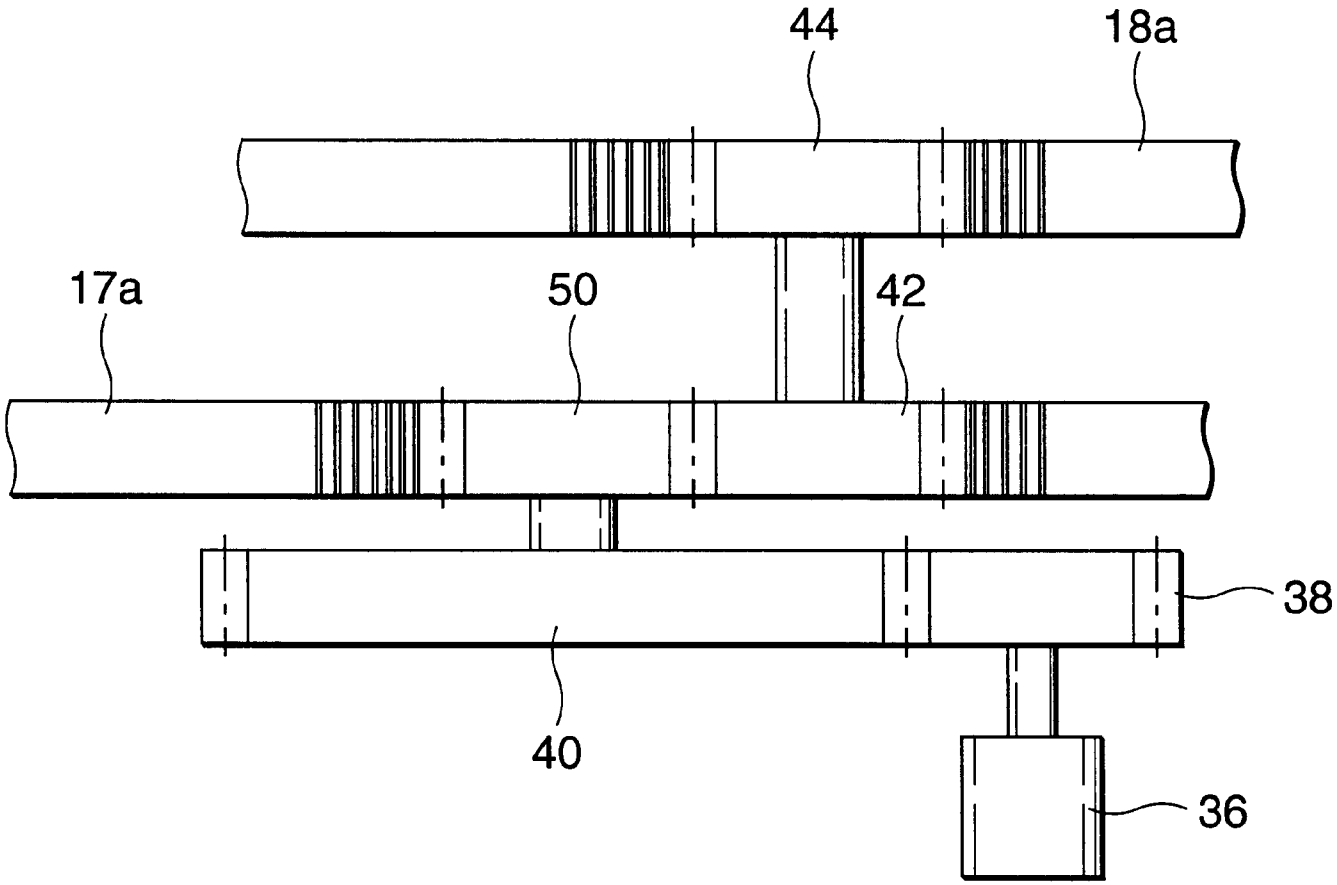
FIG. 10 is a plan view showing engagement situations between arm gears and gears which engage with arms.

In FIG. 10, gears are formed on outer peripheral surfaces of the upstream arm 17 and the downstream arm 18 on the arm supporting axis 16 side respectively. A power from a servo motor 36 is transmitted to a main gear 40 via a pinion 38, which is secured to an axis of the servo motor 36, to reduce the speed. The power is then transmitted to a gear 50, which engages with the upstream arm gear 17*a* and is rotated together with the main gear 40, and an downstream arm gear 18*a*, which is rotated together with the gear 44 via an idler gear 42. At this time, since the gear 44 engaging with the downstream arm, the idler gear 42, and a gear 50 engaging with the upstream arm 17 employ the same gears, the upstream arm 17 and the downstream arm 18 can be opened/closed symmetrically about the shaft center X—X line to separate from each other. In other words, this mechanism is employed when the upstream arm 17 and the downstream arm 18 are opened simultaneously in the finishing feed step. As an example, in a following period in which the upstream arm 17 and the downstream arm 18 are not operated simultaneously, the upstream arm gear 17*a* and a downstream arm gear 18*a* do not engage with the gear 50 engaging with the upstream arm 17 and the gear 44 engaging with the downstream arm 18 respectively (no tooth is formed), and are constructed to slide with the gears 50 and 44, respectively. Open/close position control and torque control of the guide rollers can be performed by the servo motor 36.

Figure 4:
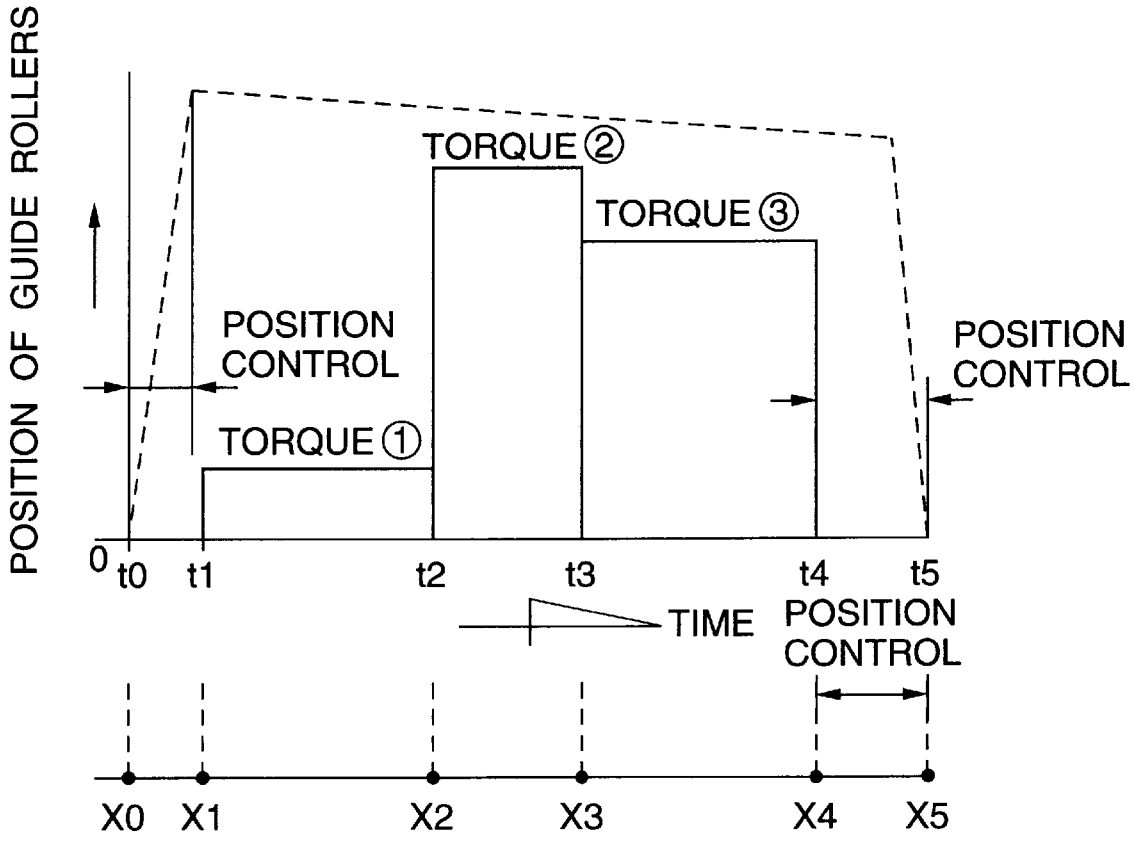
FIG. 4 is a graph showing a relationship between guide roller position/torque and a time in the embodiments of the present invention, and showing values of a current position counter relative to the time in FIG. 3.
Figure 5:
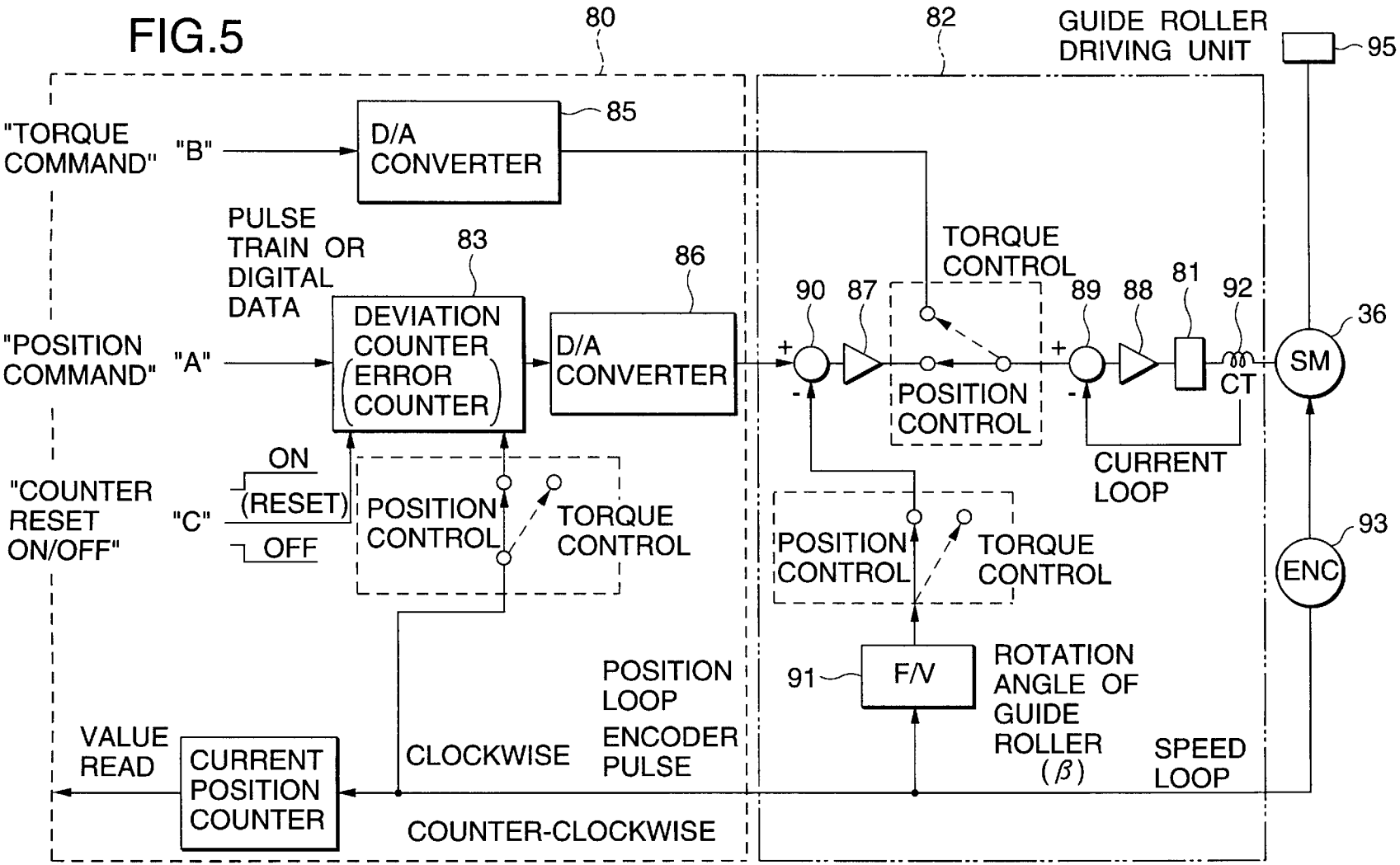
FIG. 5 is a block diagram showing a servo motor control system in the embodiments of the present invention.
Figure 6:
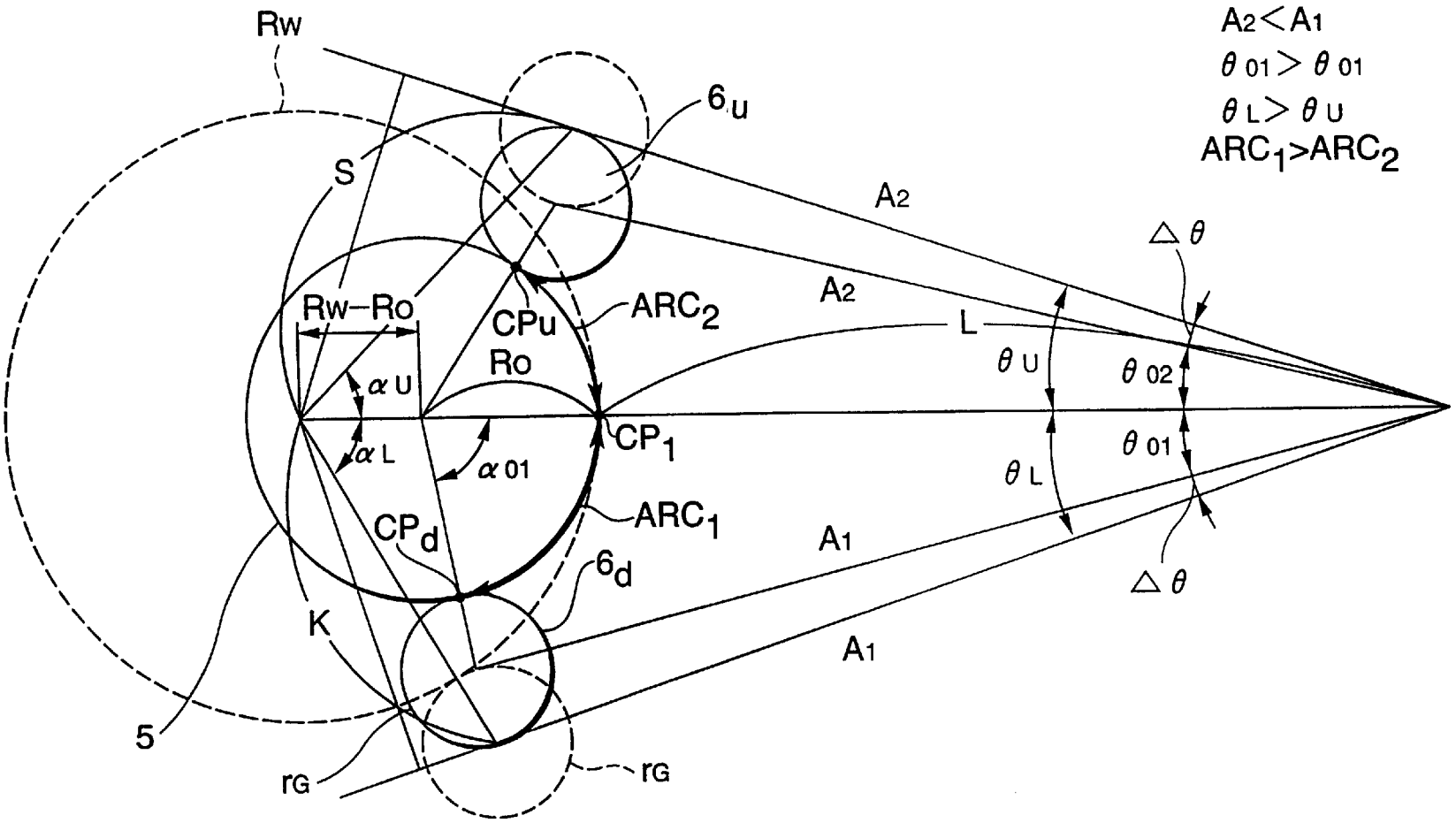
FIG. 6 is a diagram showing conditions for pushing the work by a downstream guide roller after releasing an upstream guide roller from the work in finishing feed step.

Next, position control and torque control of the guide rollers will be explained with reference to FIG. 5 hereunder. A symbol "A" (position sensor signal of the outer diameter of the work 5) shown on the left side of FIG. 5 is a position command signal for 1) x1 (see FIG. 4) which is a position at a time t1 as a terminating point of the quick feed, and 2) x5 which is a position from a time t4 as a terminating point of the finishing feed to a return point (home position) of the guide rollers. The position command signal is supplied to a deviation counter (error counter) 83 as digital data (pulse train) . A symbol "B" is a torque command signal for 1) a torque in the initial feed from the time t1 to a time t2, 2) a torque in the rough feed from the time t2 to a time t3, and 3) a torque in the finishing feed from the time t3 to the time t4. A torque is set as a value which can be output from a servo motor 36. When the torques in excess of these values are applied to the guide rollers 6, the guide rollers 6 are released not to apply the pushing force exceeding the set torque to the work 5. A symbol "C" is a start command signal for 1) closing position of the guide rollers 6 (start time of the initial feed from the time t0 to the time t1), and 2) opening position of the guide rollers 6 (finishing feed termination at the time t4).

The current position counter 84 counts current positions indicating to what degree the guide rollers 6 come close to the work 5 from the return position (home position). Assume that a direction along which the guide rollers 6 come close to the work 5 is set as a plus direction, and a direction along which the guide rollers 6 go away from the work 5 is set as a minus direction. The deviation counter (error counter) 83 counts movement of a rack (not shown) of a rack and pinion, which is produced by a rotation of the pinion 38 engaging with the main gear 40. More particularly, the deviation counter 83 is employed to execute the position control of the guide rollers 6 by comparing moving amounts of the guide rollers 6 derived from the home position to the termination of the quick feed and from the termination of the finishing feed to the home position with respect to the set values (change amounts of the guide rollers 6 relative to the set values) with encoder pulse supplied from an encoder 93, which detects the rotating state of the servo motor 36. The current position counter 84 for the guide rollers 6 may not be cleared to always monitor the current position even after the initial feed has been completed, and thus an output of the current position counter 84 may be utilized as abnormal detection or a start signal for unloading. Values of the current position counter 84 at the termination time of both the quick feed and the finishing feed are input into the deviation counter 83.

Next, a description will be given of the processes of the rolling processing with reference to FIG. 7. At first, the "work loading" is carried out. The loading is to set the work 5 as the annular body onto the annular body forming apparatus. In setting, the mandrel 4 is inserted so as to hold an inner peripheral surface of the work 5.

Figure 7:
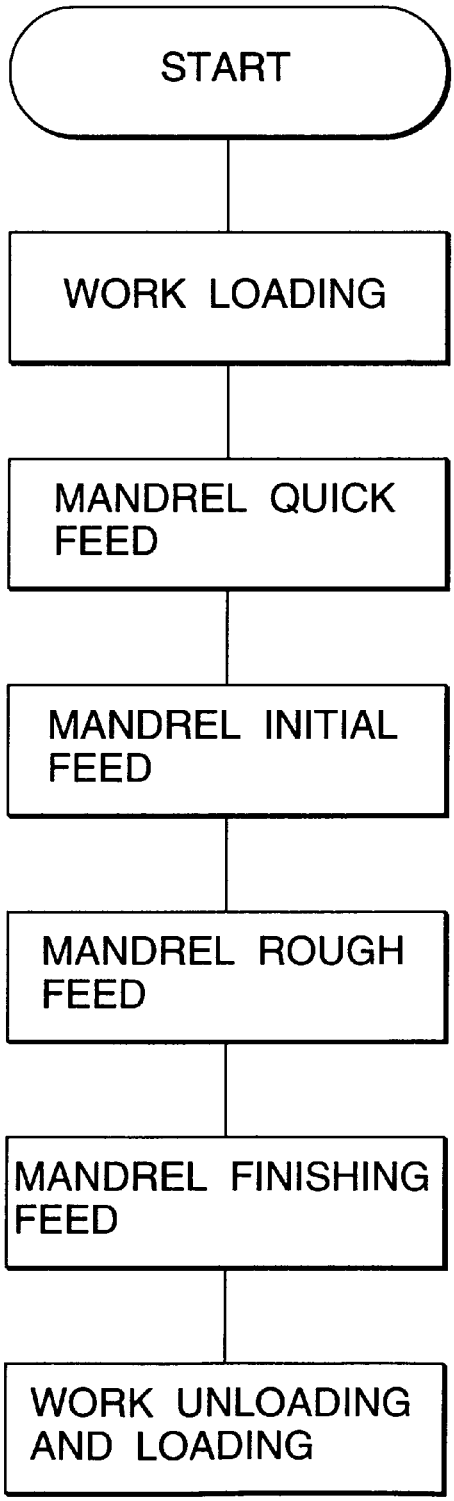
FIG. 7 is a flowchart showing rolling process of the work.

In the "mandrel quick feed" in FIG. 7, the mandrel 4 which is inserted into the work 5 is moved in close to the forming roller 3 quickly (at a maximum speed) in the quick feed. This quick feed is carried out as one of preset feeds which shift the mandrel 4 to a rolling start point of the work 5. In order to prevent the collision of the work 5 against the forming roller 3 during the quick feed, a feed amount L1 of the mandrel 4 in the quick feed is set such that the quick feed can be ended in some measure before the supposed rolling start point.

The position control is performed by the deviation counter 83. First, the deviation counter 83 and the current position counter 84 are reset to "0" at the time t0. In the graph of FIG. 4, a dot-dash line indicates a monitoring range in which positions of the guide rollers 6 are monitored by the current position counter 84 provided in a controller 80. Solid lines indicate torque set values of the servo motor 36 (hydraulic forces in the case of a hydraulic system) in respective feed steps of the mandrel 4 respectively.

The work 5 comes into contact with the forming roller 3 according to movement of the mandrel 4 (shift from the time t0 to the time t1). The value of the current position counter 84 is changed according to movement of the guide rollers 6. For example, the value of the current position counter 84 becomes "10,000" at the time t1. The value "10,000" of the current position counter 84 is input previously into the deviation counter 83 as a position command. The deviation counter 83 compares whether or not the pulse which are output from the encoder in the servo motor (not shown) which drives the mandrel 4 coincide with the position command. If the pulse coincide with the position command, the position control of the guide rollers 6 toward the work side is ended. The deviation counter 83 is reset to "0" when the position control is ended.

The quick feed which is executed as other one of the preset feeds prior to rolling start of the work 5 is executed to eliminate the disadvantage due to time lag in detection of the contact between the work 5 and the forming roller 3. In other words, the quick feed is executed to perform the contact state between the moulding profile of the forming roller 3 and the work 5 more correctly without fail. At this point of time, the guide rollers 6 finish the position control, to thereby shift to the time t1. When the feed amount L of the mandrel 4 reaches L1 shown in FIG. 3, then the feed speed of the forming roller 3 is reduced, and the position control in the initial feed of the guide rollers 6 is ended. The guide rollers 6 are shifted to the torque control in the initial feed.

In the "mandrel initial feed" shown in FIG. 7, the outer peripheral surface of the work 5 comes into point contact with the outer peripheral surface of the forming roller 3 at the time t1. Thus, the rolling of the work 5 by the point contact is commenced, and the work 5 is then rotated by a rotating force of the forming roller 3 (the mandrel 4 is a following roller) in the situation the work 5 is put between the forming roller 3 and the mandrel 4. The load of a forming roller driving motor (not shown) which drives and rotates the forming roller 3 is then increased, and thus a driving power of the driving motor is increased. The initial feed of the mandrel 4 is controlled by the encoder command from the servo motor (not shown) which drives the mandrel 4. When the work 5 comes into point contact with the forming roller 3, the encoder command in the initial feed of the mandrel 4 is terminated (time t2), and then the feed speed of the mandrel 4 is reduced. The encoder command from the servo motor (not shown) which drives the mandrel 4 switches the initial feed to the rough feed.

The "mandrel rough feed" shown in FIG. 7 is one of working feeds for rolling the work 5 by virtue of the surface contact. The mandrel 4 is moved by the rough feed until the outer diameter of the work 5 comes substantially up to a desired outer diameter. In order to increase the draft amount in the rough feed, the larger torque set value (voltage value) than that in the initial feed is selected, and the work 5 is held firmly from the outer diameter side by two guide rollers 6. The moving speed of the mandrel 4 in the rough feed is set smaller than that in the initial feed.

Figure 3:
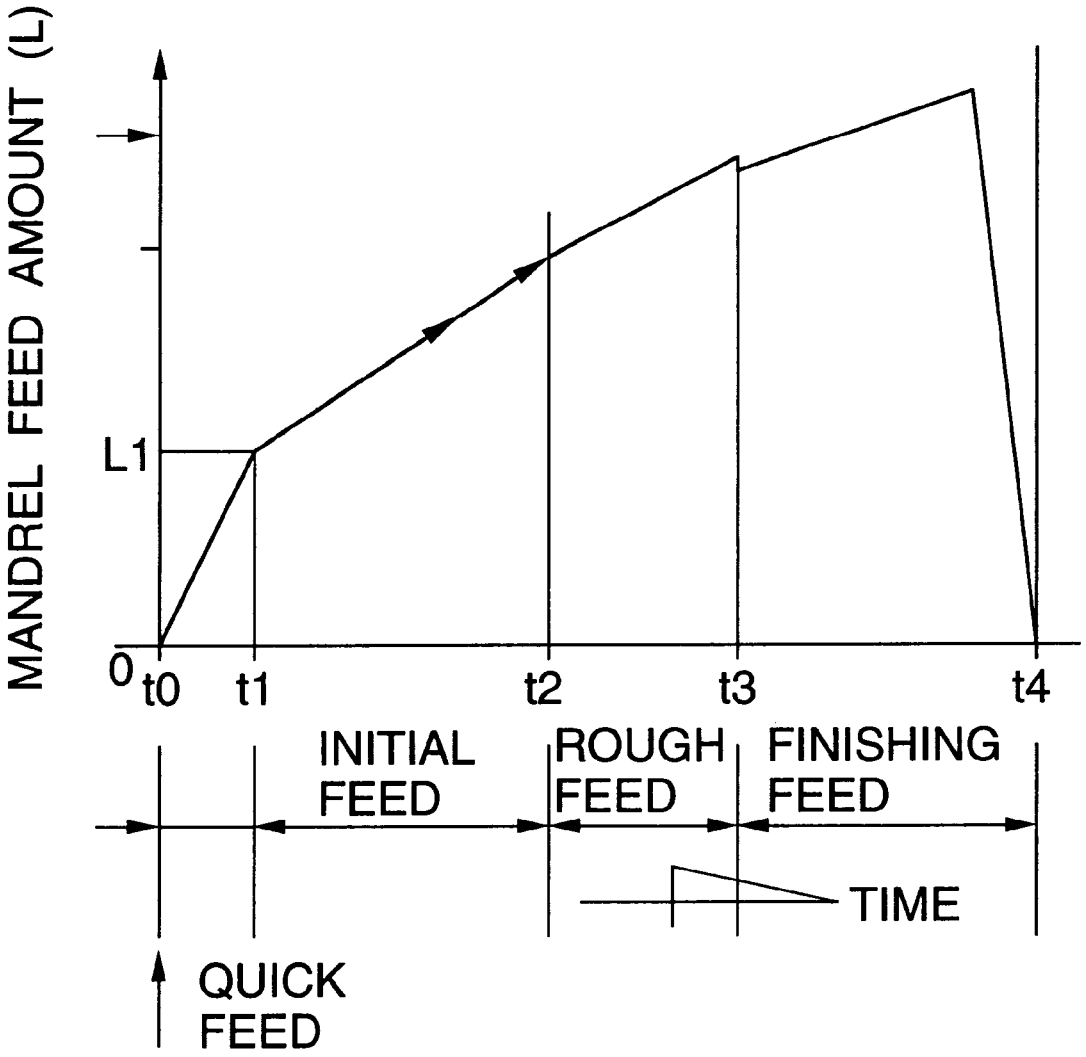
FIG. 3 is a graph showing a mandrel feed amount against a forming roller of the annular body forming apparatus with a lapsed time.

When the encoder command in the rough feed of the mandrel 4 is ended (time t3) and then a terminating position of the rough feed is detected by a dimension fixing lever 14 for the work 5, retraction for returning the feed to eliminate one type backlash shown in FIG. 3 is executed. More particularly, the forming load for pushing the mandrel 4 against the forming roller 3 via the work 5 is generated and thus the elastic deformation is caused in the first support block 2, the second support block 10, the tie rod 11, etc. The mandrel 4 is slightly retreated not to have an influence of the elastic deformation on the feed amount of the mandrel 4. Since a rolling force is generated gradually with the progress of the rolling process in the rough feed, the diameter expansion of the work 5 is started. At this time, the guide rollers 6 are pushed by the work 5 to be forcibly moved gradually to the opening direction, and they act to apply the pushing force to the work 5 by the same force based on the torque control of the servo motor. When it is detected by the dimension fixing lever 14 at the time t3 that the work 5 is rolled to substantially expand the outer diameter of the work 5 to a desired outer diameter, the feed of the mandrel 4 is switched from the rough feed to the finishing feed with lower feed speed.

The "mandrel finishing feed" shown in FIG. 7 is a working feed which is executed to roll the work 5, which has been rolled to expand roughly its outer diameter to a desired outer diameter, and to expand precisely the outer diameter of the work 5 to the desired outer diameter. Accordingly, the draft amount is reduced in the finishing feed, and the torque set value (voltage value) of the guide rollers is lowered than that in the rough feed to be then switched to a torque set value in the finishing feed. If it is detected by the dimension fixing lever 14 that the outer diameter of the work 5 has been expanded to a finishing dimension, the finishing feed has been completed and the rolling process has been completed, and the process goes to the time t4. At this time, for example, assume that the value "8,500" is displayed in the current position counter. This value is reduced smaller than the value "10,000" in the current position counter at the time t1. This is because the guide rollers are pushed back at the end of working of the work 5 after the outer diameter of the work 5 has been expanded.

Then, the guide rollers 6 are returned from the torque control to the position control, and the guide rollers 6 and the mandrel 4 are returned to their initial positions and then the process is ended. In unloading and loading steps, when a finishing outer dimension is detected by a signal from the dimension fixing lever 14, the guide rollers are switched from the torque control to the position control and then a quick return operation is carried out. Then, "8,500" of the current position counter 84, which is the value at the time t4 of the finishing feed termination, is set to "−8,500" by changing a sign into minus, and is input into the deviation counter 83. According to the above, the position command is compared with the encoder pulse from the servo motor of the guide rollers 6, and then the guide rollers 6 are returned to the home position if they coincide with each other. The position command for the deviation counter 83 can set the value of the deviation counter 83 at the time t1 of the quick feed termination into a constant value, nevertheless the time t4 of the finishing feed termination cannot be set to a constant value because it is affected by the thickness of the work as a finished product or slight thickness deviation. Therefore, the value of the current position counter 84 at the time t4 is employed every work process as the value of the deviation counter 83.

In this manner, as shown in FIG. 4, the position control can be executed during the time period of the quick feed from the time t0 to the time t1 and during the unloading time as the minute time period from the time t4. The switching signal at the time t1, t2, t3 and t4 may be applied via the dimension fixing lever 14. The position signal of the dimension fixing lever 14 can be generated by an electric micro, a linear scale, etc. In this case, as shown in FIG. 4, the position corresponding to the time t1 is x1, the position corresponding to the time t2 is x2, the position corresponding to the time t3 is x3, and the position corresponding to the time t4 is x4. The position control is carried out based on differences of (xn-x1).

Next, a configuration of circuits of a guide roller driving apparatus will be explained with reference to FIG. 5 hereunder. FIG. 5 is a block diagram showing a servo motor control system in the embodiment of the present invention.

Circuits of the tool controlling apparatus, if roughly classified, are composed of a controller 80 and a motor driver 82. Switches "A", "B", "C" into which signals are input externally are provided to the controller 80. The signal for the position control (referred to as "position command" hereinafter) is input into the switches "A" and "C", and the signal for the torque control (referred to as "torque command" hereinafter) is input into the switch "B". The deviation counter 83 and a D/A converter 86, to which the signal is supplied from the switch "C", are provided in the controller 80. Also, the current position counter 84 which receives encoder pulse supplied from the encoder is provided in the controller 80. The deviation counter 83 detects difference between the encoder pulse and the position command. The switch "C" for switching the position control and the torque control is provided between the deviation counter 83 and the current position counter 84. In addition, a D/A converter 85 which receives the torque command is also provided.

In the motor driver 82, there is provided a differential computing unit (differential amplifier) 90 which calculates difference between the position command supplied from the D/A converter 86 and the encoder pulse which are converted by a frequency/voltage (abbreviated as "F/V" hereinafter) converter 91. A switch for switching the position control and the torque control is provided between the differential amplifier 90 and the F/V converter 91. An output of the differential amplifier 90 is amplified by a speed amplifier 87. Another switch for switching the position control and the torque control is connected to the speed amplifier 87 in the middle of a path toward a current amplifier 88. This switch is also connected to a D/A converter 85 in the controller 80. A current differential computing unit (differential amplifier) 89 which is connected to the switch is then connected to the current amplifier 88 and a power amplifier 81. A CT (current transformer) 92 which detects a current to be supplied to the servo motor 36 is provided on the output side of the power amplifier 81, and is connected to the servo motor 36. A signal from the servo motor 36 is supplied to a guide roller driving unit 95. The encoder 93 is provided in the servo motor 36. The CT 92 adjusts a motor current (current supplied to the servo motor 36) from the power amplifier 81, and the current amplifier 88 amplifies the signal from the current differential amplifier 89. A speed loop is formed between the encoder 93 and the F/V converter 91. The encoder pulse supplied from the encoder 93 are input into the F/V converter 91, then the number of pulse per frequency is derived to then calculate an angular velocity, and then the speed of the guide rollers 6 are decided, whereby the speed loop is formed. The position loop is formed between the encoder 93 and the deviation counter 83 since the encoder pulse are output from the encoder 93. In this case, the encoder pulse are output clockwise if the guide rollers 6 are moved to the plus direction, and they are output counter-clockwise if the guide rollers 6 are moved to the minus direction.

As circuit operations every time, only the position command supplied from the switch "A" is given since the position control is carried out from the time t0 to the time t1. More particularly, a "guide roller closing position" signal is given. For example, the value of "10,000" is input in the embodiment. This value of "10,000" is derived previously by the actual measurement. The switch provided below the deviation counter 83 in the controller 80 is connected to the position control and also all switches in the motor driver 82 are connected to the position control. The signal input into the switch "A" in the controller 80 as the position command is converted into a voltage value by the D/A converter 86. The converted signal is input into the motor driver 82 and is current-amplified by the amplifiers. Then, the position command is given to the servo motor 36 and the supplied to the guide roller driving unit 95. The signal is sent from the guide roller driving unit 95 to the servo motor 36. The feedback signal (encoder pulse) is output from the encoder 93. This is position information of the guide rollers sent out from the encoder 93. Hence, this can be grasped as a rotation angle of the guide rollers.

The encoder pulse from the encoder 93 is sent to a counter (not shown) in the controller 80 and separated into two ways. In one way, difference between the position command and the encoder pulse is detected by the differential amplifier in the deviation counter 83. In the other way, the signal from a counter (not shown) is added or subtracted by the current position counter 84. When the difference value in the deviation counter 83 becomes "0", the circuit operation from the time t0 to the time t1 is stopped. The encoder pulse is input into the F/V converter 91 where the pulse per unit time is converted into the voltage value, and such voltage value is input into the differential amplifier 90. Then, difference between such voltage value and the voltage value of the output signal from the D/A converter 86 (position command signal) is calculated by the differential amplifier 90. Here the difference between analog values is calculated. It is possible to detect the abnormal operation of the guide rollers based on this difference value.

Then, based on position information of the push-down slide 8 of the mandrel 4 at the time t1 or position information derived from the dimension fixing lever 14, the guide rollers 6 are switched to the torque control ranging from the time t1 to the time t2. The switches provided in the controller 80 and the motor driver 82 are switched from the position control to the torque control at the point of time t1. The torque command in the initial feed is supplied from the switch "B" to the controller 80 and also the deviation counter 83 is reset by the control signal from the switch "C". The torque command in the initial feed is converted into the voltage value by the D/A converter 85. The voltage value is sent to the motor driver 82, and then is amplified by various amplifiers, and then the current value amplified by the power amplifier 81 is supplied to the servo motor 36. The feedback signal (encoder pulse) is output from the encoder 93 of the servo motor 36. The difference between the current signal from the CT 92 concerning the torque and the voltage value of the output signal based on the torque command in the initial feed is calculated by the differential amplifier 89, whereby the current loop is formed. The difference value is amplified by various amplifiers and the current value is output to the servo motor 36 and transmitted to the guide roller driving unit 95. The encoder pulse from the encoder 93 is sent to the current position counter 84 via the counter (not shown) to be added or subtracted.

Similarly, the torque control is carried out from the time t2 to the time t3 and from the time t3 to the time t4. Switchings at respective times are conducted based on the push-down position information of the mandrel 4 or the signal derived from the dimension fixing lever 14. The switches in the controller 80 and the motor driver 82 are kept at the torque control condition. In operation, according to the current loop between the differential amplifier 89 and the CT 92, the amplified current is output from the power amplifier 81, then change in the current is converted into change in the voltage by the CT 92, then the difference between the voltage value and the voltage value of the output signal based on the torque command is calculated by the differential amplifier 89. Then the difference value is output to the servo motor 36 via the current amplifier 88 and the power amplifier 81 and sent to the guide roller driving unit 95. The encoder pulse from the encoder 93 is also sent to the current position counter 84 via the counter (not shown) to be added or subtracted.

Since the mandrel 4 is returned to the home position at the time t4, the process is switched to the position control. Based on position information of the push-down slide 8 of the mandrel 4 or position information derived from the dimension fixing lever 14, the switches in the controller 80 and the motor driver 82 are switched from the torque control to the position control at the time t4, so that the position loop is operated. Reset of the deviation counter 83 is brought into a released state (counter start state) by the control of the switch "C". Next, in order to render the value of the current position counter 84 return to the target value "0", the value of the current position counter 84 at the time t4 (position x4 of the rear edge of the mandrel) is read and then "0 value-the value of the current position counter 84" is calculated, and then the result is input into the switch "A". The difference between the encoder pulse supplied from the encoder 93 in the servo motor 36 and the position command from the switch "A" is detected by the differential amplifier in the deviation counter 83, and then the above operation is continued until the difference value becomes "0". The guide rollers 6 are returned to the home position at the point of time when the difference value is "0".

Second Embodiment

The invention shown in the second embodiment corresponds to a mechanism that, in order to achieve the improvement of the circularity of the work 5 in the finishing feed step, the downstream guide roller is brought into contact with the work 5 (to continue to apply a constant torque) but the upstream guide roller is released (non-contact state with the work 5).

Figure 11:
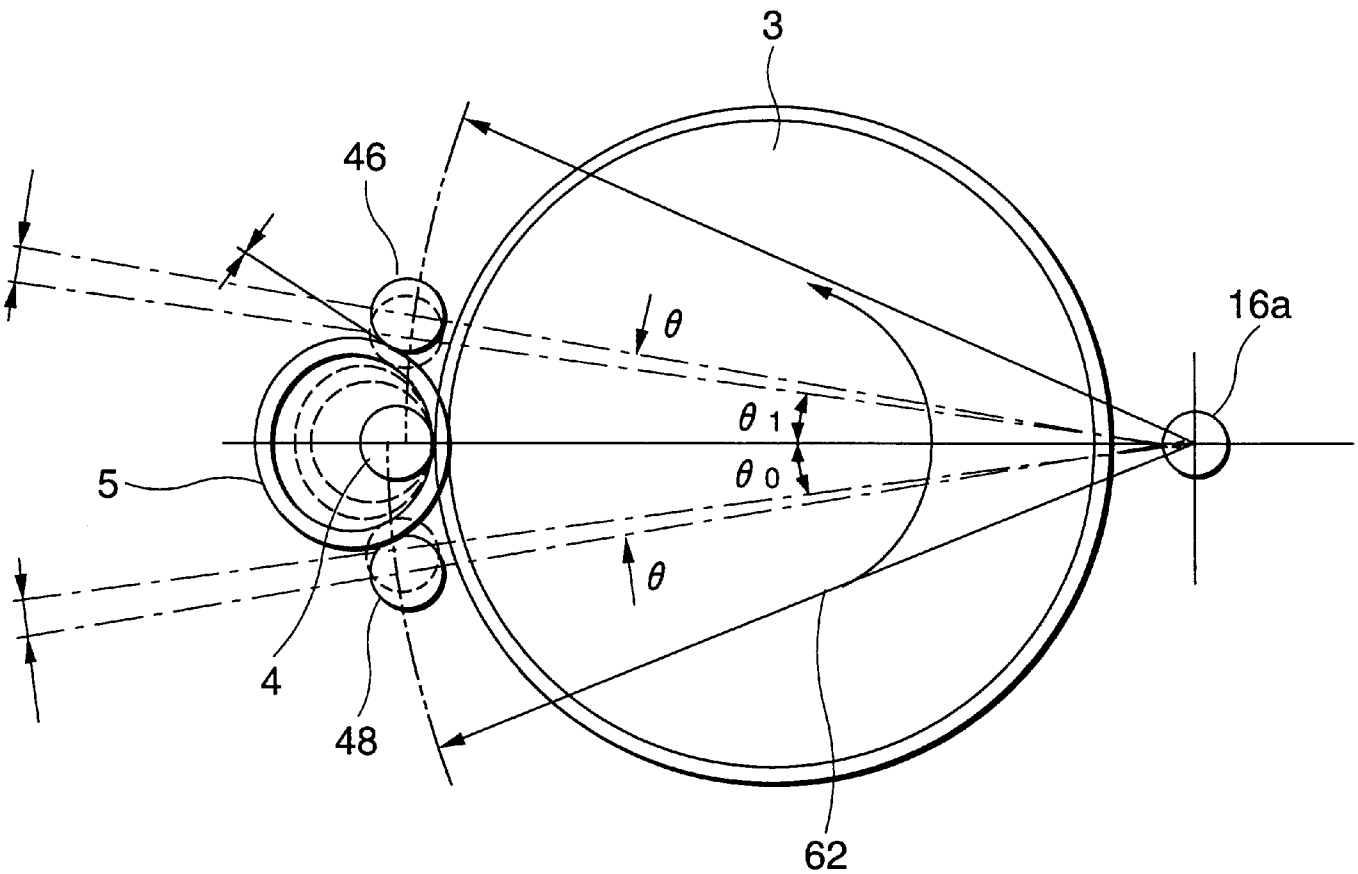
FIG. 11 is a plan view showing a second embodiment which has one arm supporting axis.
Figures 15, 16:
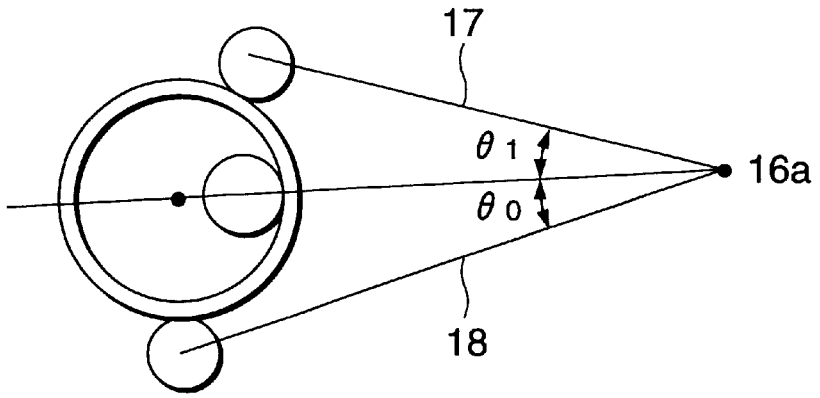
FIG. 15 is a table in which the work which is treated by cold rolling according to this method and the work 5 which is restricted by upstream and downstream guide rollers in the finishing step, like the related art, are compared with each other.
FIG. 16 is a schematic view showing the second embodiment which has one arm supporting axis.

FIG. 11 is a plan view showing a second embodiment which has one arm supporting axis. FIG. 16 is a schematic view showing a second embodiment which has one arm supporting axis at the time of starting the finishing feed step. FIG. 11 shows the situation that, in the case of one arm supporting axis, the upstream arm is pushed back because the torque is switched from the rough feed torque to the finishing feed torque. The work 5, the upstream guide roller 46, and the downstream guide roller 48, all being depicted by a broken line, correspond to respective states before the rolling process in the finishing feed is applied to them. The work 5, which is depicted by a solid line, corresponds to the work 5 whose diameter is expanded by the finishing feed. The upstream guide roller 46 and the downstream guide roller 48, which are depicted by the solid line, corresponds to their shifted state by the diameter expansion of the work 5. If a distance between a center 16*a* of the arm supporting axis and a top end of the downstream guide roller 48 is set longer than a distance between the center 16*a* of the arm supporting axis and a top end of the upstream guide roller 46, the upstream arm 17 has larger displacement relative to the work 5 (relative to the same θ) than that of the downstream arm 18 after the torque is switched to the finishing torque. Therefore, the upstream arm 17 is brought into the non-contact state (non-contact state with the outer surface of the work 5), and the downstream arm 18 is brought into the contact state (torque control). At this time, the downstream guide roller 48 comes into contact with the outer peripheral surface of the work 5, but the upstream guide roller 46 is separated from the outer peripheral surface of the work 5 since a length of the upstream arm 17 is shorter than the downstream arm 18. As a result, a clearance is generated between the upstream guide roller 46 and the outer peripheral surface of the work 5, so that the upstream guide roller 46 is released. Accordingly, circularity of the work 5 can be improved since the work 5 is held by the downstream guide roller 48 in the finishing feed.

An example in which friction drive and gear drive are properly used respectively as the drive of the upstream arm 17 and the downstream arm 18 in FIG. 11 will be explained hereunder. When the guide rollers are during the quick feed and the term returned from the completion of the finishing feed to the home position, in which the position control shown in FIG. 4 is executed, the gear drive is employed. At this time, a rotation driving force which is given by the servo motor 36 shown in FIG. 10 is transmitted from the gear 50 engaging with the upstream arm 17 to the upstream arm gear 17*a*, and to the downstream arm gear 18*a* via the idler gear 42, and the gear 44 engaging with the downstream arm 18 such that the upstream arm 17 and the downstream arm 18 can be opposed and separated with respect to the X—X axis by an equal angle respectively. At this time, since the relationship of (the length $A_2$ of the upstream arm 17)<(the length $A_1$ of the downstream arm 18) is satisfied, an arm opening angle $\theta i<\theta o$ as shown in FIG. 16. Thus, tooth numbers and modules of the gear 50 engaging with the upstream arm 17, the upstream arm gear 17*a* and the gear 44 engaging with the downstream arm 18, the downstream arm gear 18*a* are selected previously such that both guide rollers can come into contact with the outer peripheral surface of the work 5. In contrast, in the initial feed and the rough feed in which the torque control is executed, both the gear 50 engaging with the upstream arm 17, the upstream arm gear 17*a* and the gear 44 engaging with the downstream arm 18, the downstream arm gear 18*a* provide slide transmission using no tooth, i.e., friction drive to follow the diameter expansion of the outer peripheral surface of the work 5.

Figure 17:
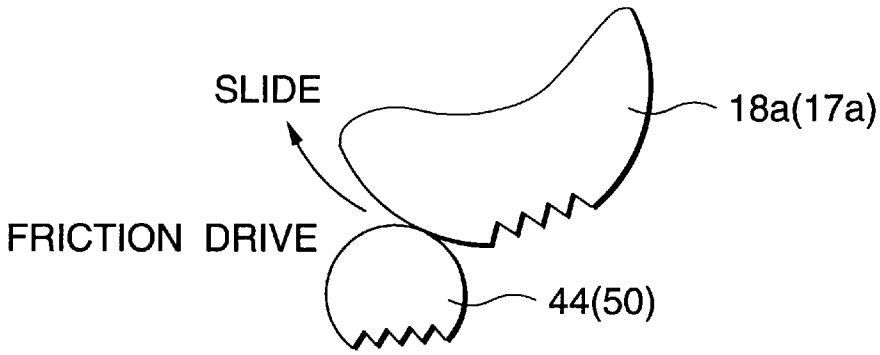
FIG. 17 is a fragmental view showing engagement between upstream and downstream arm gears and gears which engage with the upstream and downstream arms.
Figure 18:
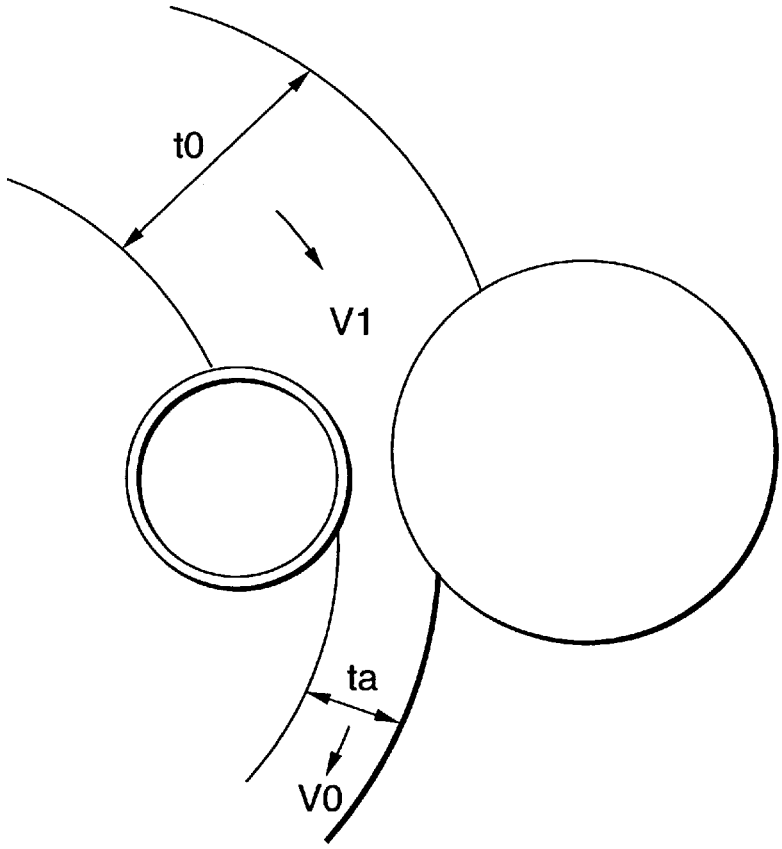
FIG. 18 is a side view showing the situation of the work which is subjected to the rolling working between a forming roller and a mandrel.
Figure 19:
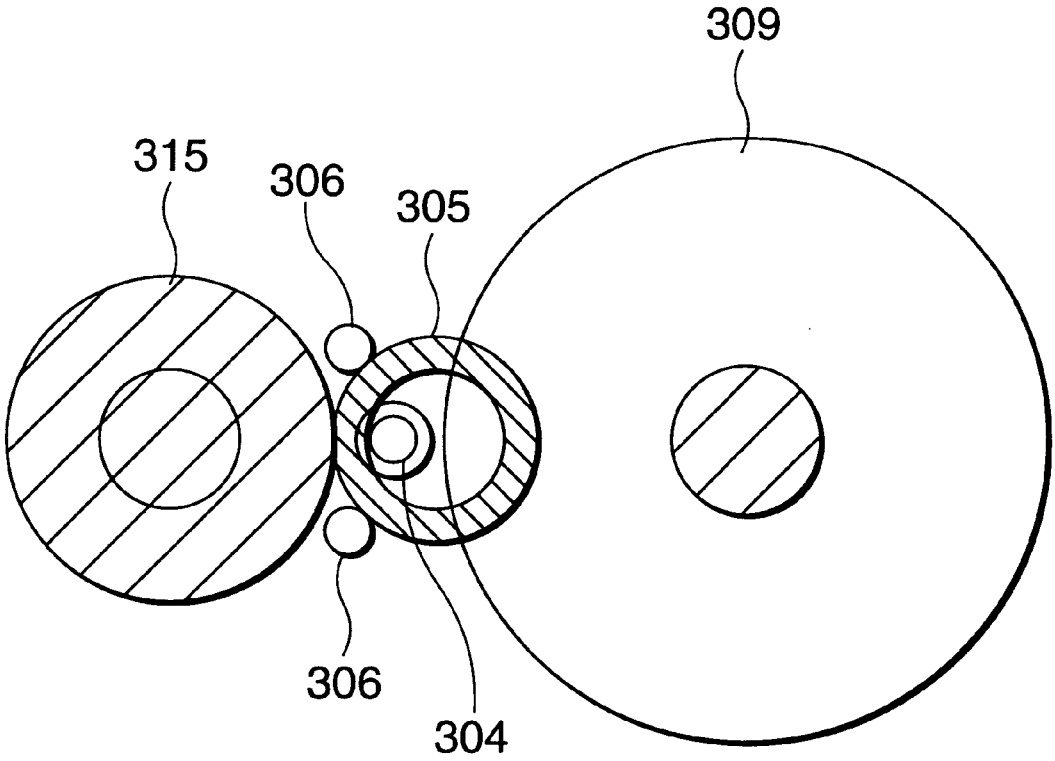
FIG. 19 is a sectional view showing the rolling situation of the annular body forming apparatus in the related art.

In the situation that the above arm driving method is applied, the finishing feed step is started. Since the guide rollers 46 and 48 are set in the state to follow the diameter expansion of the outer peripheral surface of the work 5 at the time of the rough feed termination, the arm opening angles of the relationship of $\theta i<\theta o$ can be given based on the relationship of $A_2<A_1$ shown in FIG. 16. As described in the position control previously, if the gear drive can be applied to the gear 50 engaging with the upstream arm 17, the upstream arm gear 17*a* and the gear 44 engaging with the downstream arm 18, the downstream arm gear 18*a* at the same time when the finishing feed step is started, the opening angles of the upstream guide roller 46 and the downstream guide roller 48 can be set equally with respect to the X—X axis thereafter. In other words, as shown in FIG. 17, the above arm driving can be achieved by separating respective gears into friction drive portions and gear drive portions. Since dimensions of the arm lengths A1, A2 of the upstream and downstream guide rollers 46, 48 can be known previously, the upstream guide roller 46 and the downstream guide roller 48 can be opened by the equal opening angle with respect to the X—X axis in the gear drive by previously selecting the tooth numbers and the modules respectively. When the upstream guide roller 46 and the downstream guide roller 48 are moved to follow the diameter expansion of the outer peripheral surface of the work 5, they can retreat while applying the predetermined torque (pushing force) to the outer peripheral surface of the work 5 since the friction drive (no gear) is utilized.

In FIG. 4, in the quick feed stage as the position control stage of the guide rollers, if the guide rollers 46, 48 are put close to the outer periphery of the work 5 by switching the drive from the gear drive to the friction drive slightly before start of the torque control (slightly before t1), excessive forces applied to the gears and the outer peripheral surface of the work 5 due to previous A1≠A2 can be prevented.

Also, the gear drive is applied to the upstream guide roller 46 and the downstream guide roller 48 in the finishing feed step, but the torque transmission to the outer peripheral surface of the work 5 can be conducted only by the downstream guide roller 48 as the gear drive state since the upstream guide roller 46 is away from the outer peripheral surface of the work 5. With the above, in the second embodiment, the upstream guide roller 46 and the downstream guide roller 48 are operated simultaneously via the gear drive in the finishing feed step so as to have the equal opening angle. As a result, the outer peripheral surface of the work 5 is supported only by the downstream guide roller 48 (torque control) to apply the pushing force. But, the upstream guide roller 46 and the downstream guide roller 48 have already been brought into contact with the outer diameter of the work 5 in the stage where the work 5 in FIG. 3 and FIG. 4 is rolled by the mandrel 4 and the forming roller 3 to start the expansion of the outer diameter of the work 5, i.e., after the quick feed (after the position control has been completed in the above explanation). However, if the upstream guide roller 46 and the downstream guide roller 48 are opened by the gear drive so as to open by the equal opening angle, the object of the present invention can also be achieved by supporting and pushing the outer diameter of the work 5 only by the downstream guide roller 48 (torque control) while separating the upstream guide roller 46 from the outer diameter of the work 5 from the start of the rolling of the work 5.

FIG. 15 is a table in which the work which is treated by cold rolling according to the present method and the work 5 which is restricted by the upstream and downstream guide rollers in the finishing step, like the related art, are compared with each other. According to the present invention, it is understood that suppression of the variation in the circularity can be improved about 10 times rather than the related art.

Third Embodiment

Figure 12:
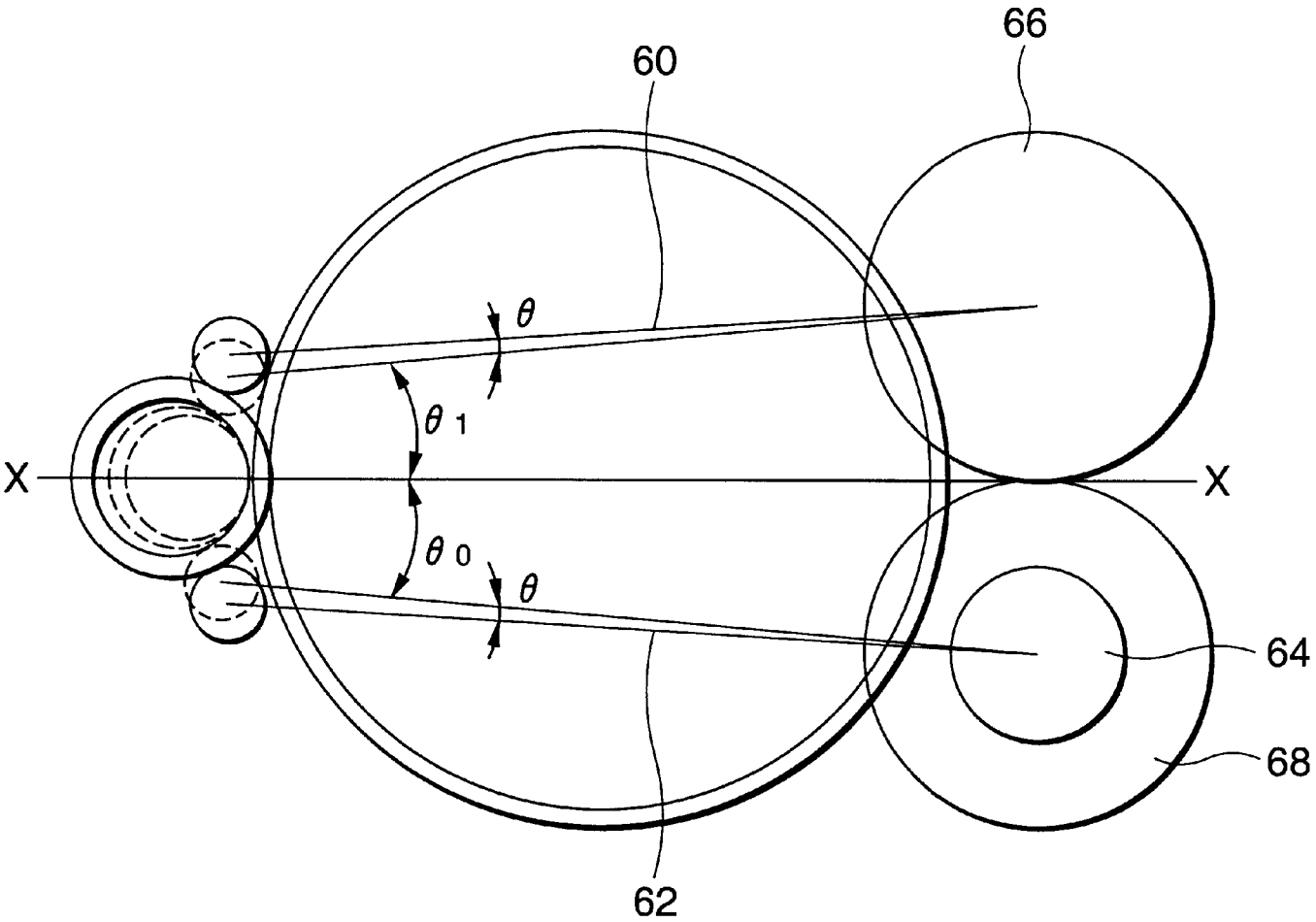
FIG. 12 is a plan view showing a third embodiment which has two arm supporting axes.

FIG. 12 is a plan view showing a third embodiment which has two arm supporting axes. In the example where the upstream and downstream guide rollers are operated simultaneously to open by the same opening angle only in the finishing feed and the upstream and downstream guide rollers are moved to follow the outer diameter of the work 5 in the initial feed and the rough feed (in this case, the upstream arm 60 maybe driven by the gear, but only the downstream arm 62 may be moved to follow), like FIG. 11, lengths of the upstream arm 60 and the downstream arm 62 are changed mutually and also the upstream arm 60 is released (is brought into non-contact state with the work 5) in the finishing feed. More particularly, a gear 64 of the servo motor is rotated by a servo motor (not shown) to rotate an arm turning gear 66 and an arm turning gear 68. According to this, the upstream arm 60 and the downstream arm 62 can be rotated. In this case, since the arm turning gear 66 and the arm turning gear 68 are rotated in the opposite direction, opening/closing of the upstream arm 60 and the downstream arm 62 are operated synchronously. θi denotes an angle decided when the guide rollers come into contact with the work 5 after the quick feed has been completed. θ denotes an angle by which the arms are equally opened on the upstream and downstream sides. Since a length R1 of the upstream arm 60 is set shorter than a length R2 of the downstream arm 62, like the second embodiment, the upstream arm 60 comes into non-contact state with the work 5 under the condition that the downstream arm 62 comes into contact with the work 5. In this case, conditions for the gear drive and the friction drive are similar to those in the above second embodiment.

Fourth Embodiment

Figure 13:
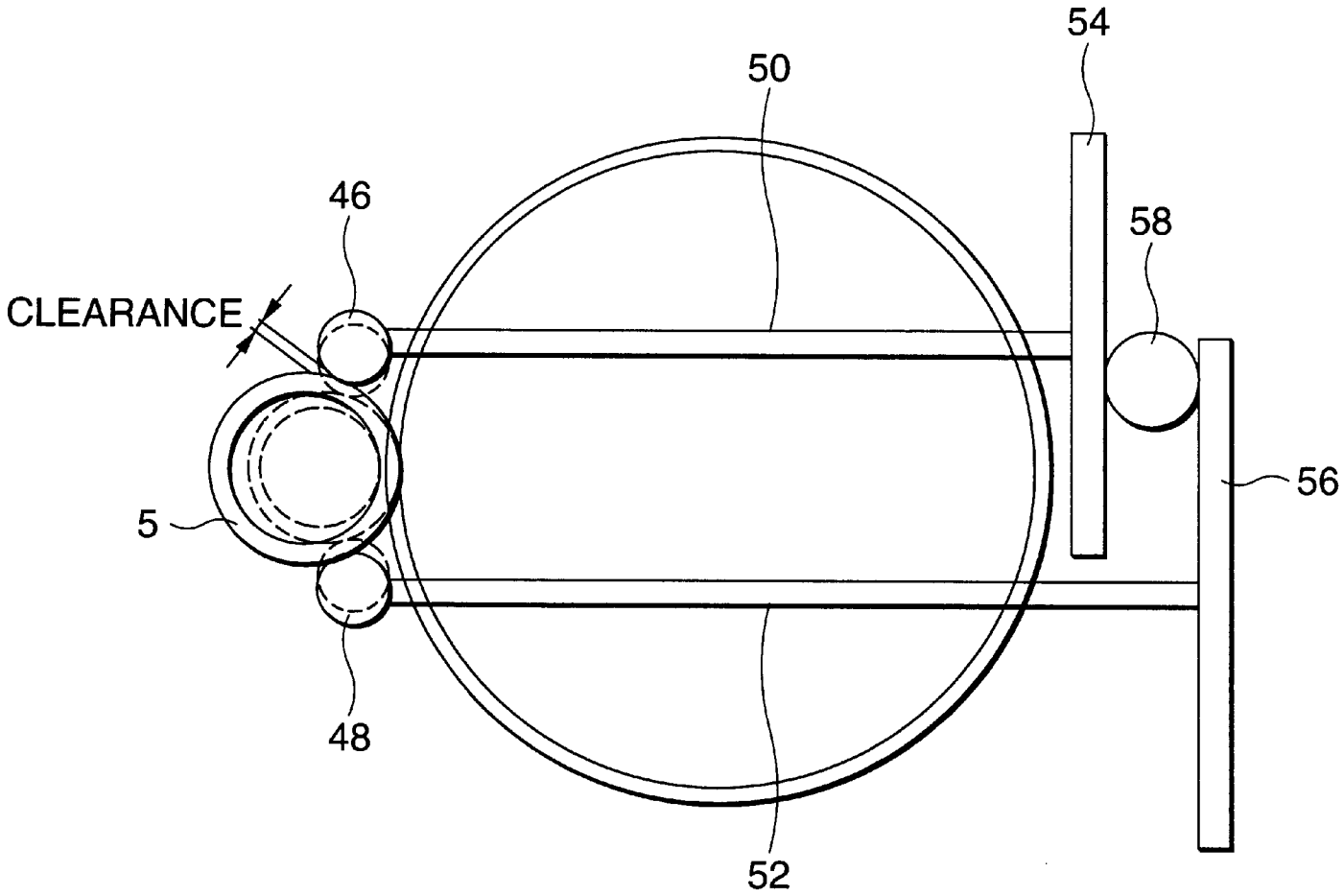
FIG. 13 is a schematic view showing a fourth embodiment which utilizes a rack and a pinion having two arm supporting axes.

FIG. 13 shows a fourth embodiment which utilizes the rack and pinion having two arm supporting axes. The upstream arm 50 and the downstream arm 52 are positioned horizontally, and a pinion 58 engages with a rack 54 and a rack 56. The upstream arm 50 and the downstream arm 52 which are fitted to the rack 54 and the rack 56 are moved in parallel vertically by rotating the pinion 58. The upstream guide roller 46 and the downstream guide roller 48 which are fitted to the upstream arm 50 and the downstream arm 52 are brought into contact with the outer periphery of the work 5 to follow and hold the outer periphery of the work 5 in the initial feed and the rough feed. In the finishing feed, if the gear drive is applied to engage the pinion 58 with the rack 54 and the rack 56 simultaneously, a clearance can be formed between the upstream guide roller 46 and the work 5 based on the relationship of (length of the upstream arm)<(length of the downstream arm) in the same configuration as in the second embodiment to hold the work 5 by the downstream guide roller 48.

Fifth Embodiment

Figure 14:
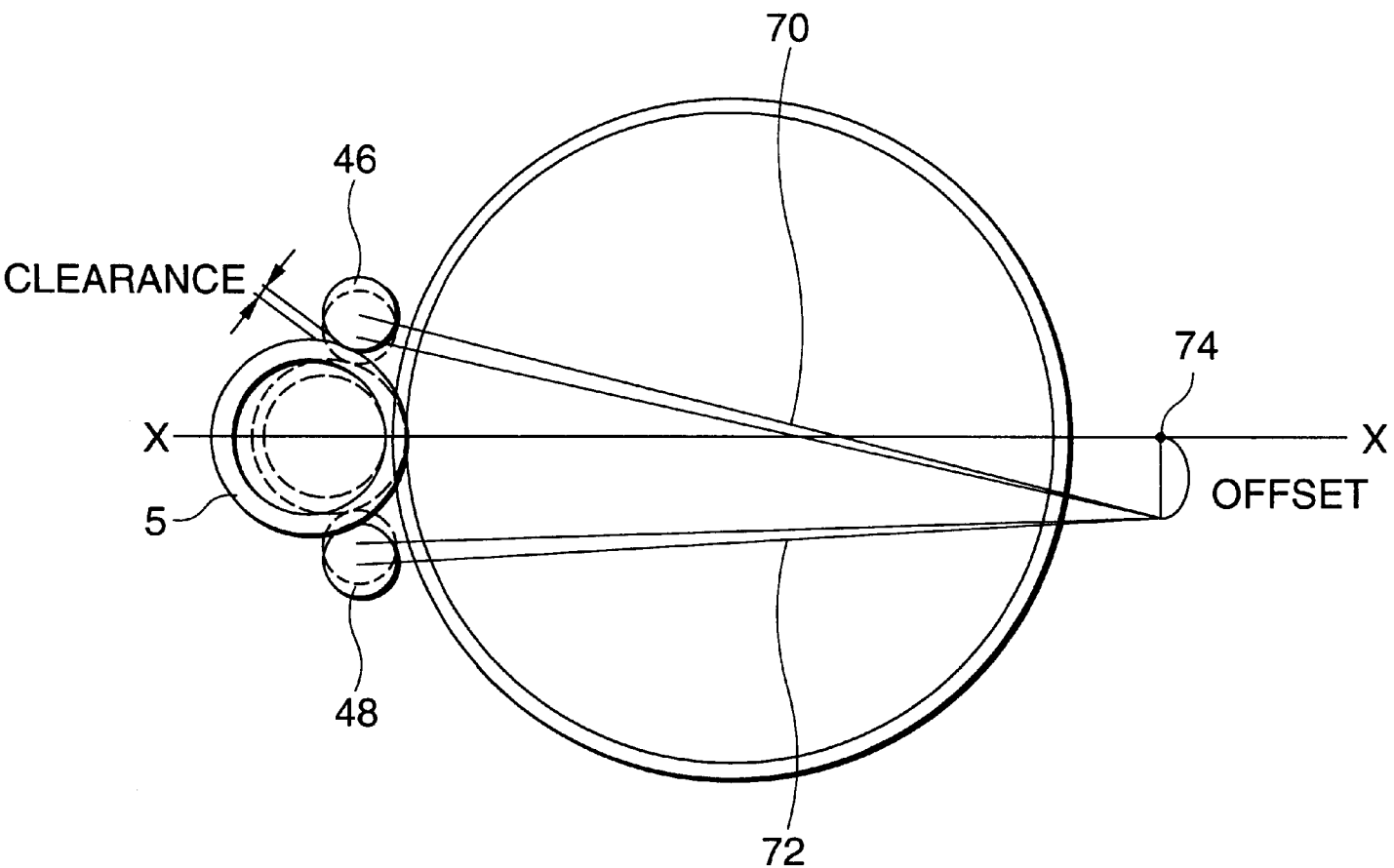
FIG. 14 is a schematic view showing a fifth embodiment in which an arm rotating center is off-set.

FIG. 14 shows a fifth embodiment in which an arm rotating center is off-set. FIG. 14 shows an example wherein arm lengths of an upstream arm 70 and a downstream arm 72 are set as li=lo and an arm turning center 74 is off-set toward the downstream side. This example is a deformed configuration in FIG. 11. In other words, a clearance is formed between the upstream guide roller 46 and the work 5 by shifting the arm turning center 74 to cause the non-contact state, and then the rolling process is carried out by bringing the downstream guide roller 48 into contact with the work 5. With the above, the explanation has been made to set the opening angle of the upstream arm and the downstream arm simultaneously and supporting the outer peripheral surface of the work 5 (torque control) only in the finishing feed step. However, like the second embodiment, the upstream arm and the downstream arm may be operated simultaneously by virtue of the gear drive from the stage when the diameter expansion of the work is started, and the outer peripheral surface of the work 5 may be supported only by the downstream guide roller 48

According to the present invention, a cycle time of the rolling process can be reduced by executing the conversion between the position control and the torque control of the guide rollers in a moment during the rolling process of the work. Also, the circularity of the work can be improved and disturbance in the diameter expansion can be prevented by switching timely the pushing of the work by means of the torque of the guide rollers from the quick feed to the work unloading.

The present disclosure relates to the subject matter contained in Japanese patent application No. Hei. 10-146874 filed on May 28, 1998 which is expressly incorporated herein by reference in its entirety.

While only certain embodiments of the invention have been specifically described herein , it will apparent that numerous modifications may be made thereto without departing from the spirit and scope of the invention.

What is claimed is:

1. An annular body forming apparatus for rolling a work having an annular shape, comprising:

a mandrel rotatably disposed inside of the work;

a forming roller disposed opposite to said mandrel so as to interpose the work therebetween at a first contact position; said forming roller being rotated in conjunction with the rotation of said mandrel, whereby the work is rolled to expand a diameter thereof; and a pair of guide rollers comprising an upstream guide roller and a downstream guide roller which are respectively disposed on an upstream side and a downstream side along a rotational direction of the work at opposite sides of an axial line connecting a rotational center of said mandrel and a rotational center of said forming roller, said upstream and downstream guide rollers being contactable with an outer periphery of the work;

wherein, when said guide rollers contact with the work, the positions of said upstream and downstream guide rollers are maintained so that a first arc of the work extending from the first contact position to a contact point of the work contacting with said downstream guide roller is longer than a second arc of the work extending from the first contact position to a contact point of the work contacting with said upstream guide roller.

2. An annular body forming apparatus according to claim 1, further comprising:

a pair of upstream and downstream revolving arms rotatably supporting said upstream and downstream guide rollers, respectively, the length of said downstream revolving arm is longer than that of said upstream revolving arm.

3. An annular body forming apparatus according to claim 2, wherein each of said upstream and downstream revolving arms is connected to a mutual arm supporting axis at one end thereof and connected to each of said upstream and downstream guide rollers at the other end thereof.

4. An annular body rolling apparatus according to claim 2, wherein in a finishing feed step of said annular body forming apparatus, said revolving arms are driven so that opening angles with respect to said axial line of said upstream guide roller and downstream guide roller are enlarged in accordance with the expansion of the diameter of the work, respectively.

5. An annular body rolling apparatus according to claim 2, wherein said upstream and downstream guide rollers are interlockingly driven by a pinion and a rack.

6. An annular body rolling apparatus according to claim 1, further comprising:

a position controlling means for controlling positions of said guide rollers; and a pushing controlling means for controlling pushing forces of said guide rollers, which are applied to the work.

* * * * *